US009665113B2

(12) United States Patent
Ciubotaru

(10) Patent No.: US 9,665,113 B2
(45) Date of Patent: May 30, 2017

(54) HIGH-SPEED MULTIPHASE PRECISION CLAMPING CIRCUIT

(71) Applicant: ANALOG DEVICES, INC., Norwood, MA (US)

(72) Inventor: Alexandru A. Ciubotaru, Somerset, NJ (US)

(73) Assignee: ANALOG DEVICES, INC., Norwood, MA (US)

( * ) Notice: Subject to any disclaimer, the term of this patent is extended or adjusted under 35 U.S.C. 154(b) by 347 days.

(21) Appl. No.: 14/284,071

(22) Filed: May 21, 2014

(65) Prior Publication Data

US 2015/0338865 A1 Nov. 26, 2015

(51) Int. Cl.
*G05F 1/575* (2006.01)

(52) U.S. Cl.
CPC ..... *G05F 1/575* (2013.01)

(58) Field of Classification Search
CPC ..... G05F 1/575
See application file for complete search history.

(56) References Cited

U.S. PATENT DOCUMENTS 8,792,218 B2 * 7/2014 Tsai ..... H01L 27/0251 361/111
2013/0155556 A1 6/2013 Tsai

OTHER PUBLICATIONS

Duong, Quoc-Tai et al., "High Dynamic Range Power Regulator Design for UHF band Near-field Passive RFID Tag Chips", 978-1-4244-5035-0/09/$26.00 © 2009 IEEE, 4 pages.
Fernández, E. et al., "Low Power Voltage Limiter Design for a Full Passive UHF RFID Sensor", 978-1-61284-857-0/11/$26.00 © 2011 IEEE, 4 pages.
Hu, Jianguo et al., "Low-Power Energy Supply Circuit for Passive RFID Transponder", 2009 IEEE International Conference on RFID, 978-1-4244-3338-4/09/$25.00 © 2009 IEEE, 6 pages.
Ker, Ming-Dou et al., "Design and Analysis of the On-Chip ESD Protection Circuit with a Constant Input Capacitance for High-Precision Analog Applications", ISCAS 2000—IEEE International Symposium on Circuits and Systems, May 28-31, 2000, Geneva, Switzerland, 0-7803-5482-6/99/$10.00 © 2000 IEEE, 4 pages.
Kim, Juseong et al., A Design of Transceiver for 13.56 MHz RFID Reader using the Peak Detector with Automatic Reference Voltage Generator and Voltage Limiter, 978-1-4244-8631-1/10/$26.00 © 2010 IEEE, 3 pages.
Laquerre, Pierre et al., "A Clamping Circuit Architecture Implementing Charges Injection Reduction Techniques", IMTC 2006—Instrumentation and Measurement Technology Conference, Sorrento, Italy Apr. 24-27, 2006, 0-7803-9360-0/06/$20.00 © 2006 IEEE, 5 pages.

(Continued)

*Primary Examiner* — Hai L Nguyen
(74) *Attorney, Agent, or Firm* — Patent Capital Group

(57) ABSTRACT

The circuit of the present disclosure is a high-speed precision clamp (voltage limiter) for overvoltage or undervoltage protection. One aspect of the circuit includes using a peak detector in the feedback path of a clamp having a super-diode architecture. The resulting circuit performs well for high-speed applications. The peak detector can be replicated (at least in part) to accommodate a multiplicity of phase-shifted input voltages by using only one common peak detection capacitor and ensuring area savings in integrated-circuit implementations.

24 Claims, 30 Drawing Sheets

(56) References Cited

OTHER PUBLICATIONS

Salcedo, Javier A., "Power Supply Clamp for Multi-Domain Mixed-Signal SiGe BiCMOS Applications", 978-1-4799-0113-5/13/$31.00 © 2013 IEEE, 6 pages.
Sedra, Adel S et al., "Microelectronic Circuits" (5th Edition), Oxford University Press, © 1982, 1987, 1991, 1998, 2004, ISBN 0-19-514252-7, 8 pages.
Silver-Martinez, Jose, "Adjustable CMOS Voltage Limiters for Low-Voltage Applications", 0-7803-3073-0/96/$5.00 © 1996 IEEE, 4 pages.
"Chapter 7: Diode application topics", Analog Devices, Rev Sep. 1, 2013 19:02, www.analog.com, 19 pages.

* cited by examiner

HIGH-SPEED MULTIPHASE PRECISION CLAMPING CIRCUIT

TECHNICAL FIELD OF THE DISCLOSURE

The present invention relates to the field of integrated circuits, in particular to voltage clamps, voltage limiters, or amplitude limiters.

BACKGROUND

Integrated circuits process electrical signals to produce rich electronic applications. In some cases, electrical signals being generated from one part of a circuit need to be "clamped" or limited in order to avoid damage to another part of the circuit, or to ensure proper operation of the other part of the circuit. For cases like these, a voltage clamp (also known as voltage limiters, or amplitude limiters) can be used to provide overvoltage or undervoltage protection for different devices. Specifically, voltage clamps can limit the maximum/minimum voltages or hard limit various signal levels as dictated by signal process requirements. Voltage clamps are important in modern electronics where components can be sensitive to overvoltage or undervoltage conditions.

SUMMARY OF THE DISCLOSURE

The circuit of the present disclosure is a high-speed precision clamp (voltage limiter) for overvoltage or undervoltage protection. One aspect of the circuit includes using a peak detector in the feedback path of a clamp having a super-diode architecture. The resulting circuit performs well for high-speed applications. The peak detector can be replicated (at least in part) to accommodate a multiplicity of phase-shifted input voltages by using only one common peak detection capacitor and ensuring area savings in integrated-circuit implementations.

The high-speed precision clamp can be used in an integrated multiphase, unidirectional, high-speed precision clamp. The multiphase voltage limiter can include implementations for accommodating pseudo-differential inputs (inputs with two opposing phases), and for other multi-phase inputs having two or more different phases. A single-ended clamp can be provided for each input. The basic building block of the single-ended clamp comprises a peak detector in the feedback path of each clamping circuit having a super-diode architecture. The circuit can be configured to share a common filtering node among the single-ended clamping circuits for high-speed operation and to use a common reference voltage as the clamping threshold.

The precision of high-speed precision clamp is provided by the nonlinear action of a diode connected in the feedback path of a high-gain operational amplifier, similar to a super-diode configuration. One important aspect involves adding a peak detector in the feedback path of the super-diode structure for compensating the relatively long response time of the operational amplifier and reducing the clamping overshoot. Another important aspect involves the ability to directly connect together the peak detector outputs of several identical individual clamps (of different branches), which can subsequently serve as a clamping circuit in a multiphase system, for limiting the swing of a multiplicity of signals having different phases. In practical terms, this translates into using one shared, common capacitor for all the peak detectors, which permits area savings in integrated circuits.

BRIEF DESCRIPTION OF THE DRAWING

To provide a more complete understanding of the present disclosure and features and advantages thereof, reference is made to the following description, taken in conjunction with the accompanying figures, wherein like reference numerals represent like parts, in which.

Figure 4A:
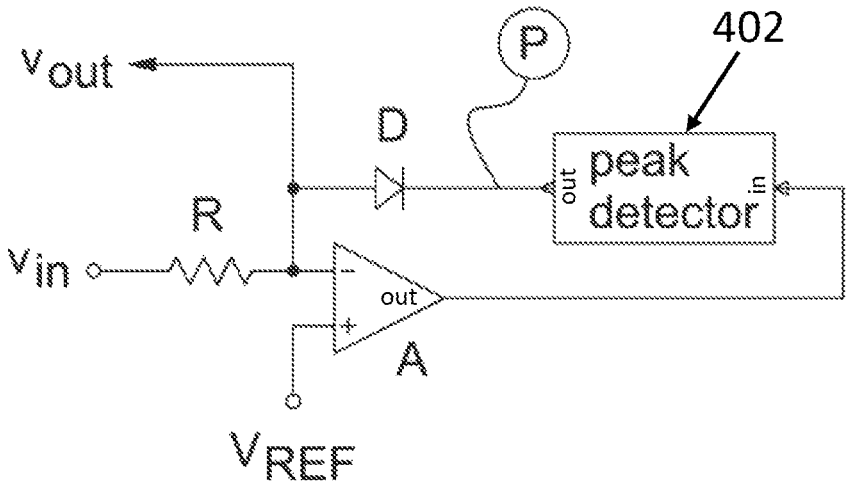
FIG. 4A is a diagram illustrating an exemplary positive-swing-limiting precision voltage clamp having an additional negative-swing peak detector in the feedback path of voltage limiter in a super-diode configuration, according to some embodiments of the disclosure.
Figure 4B:
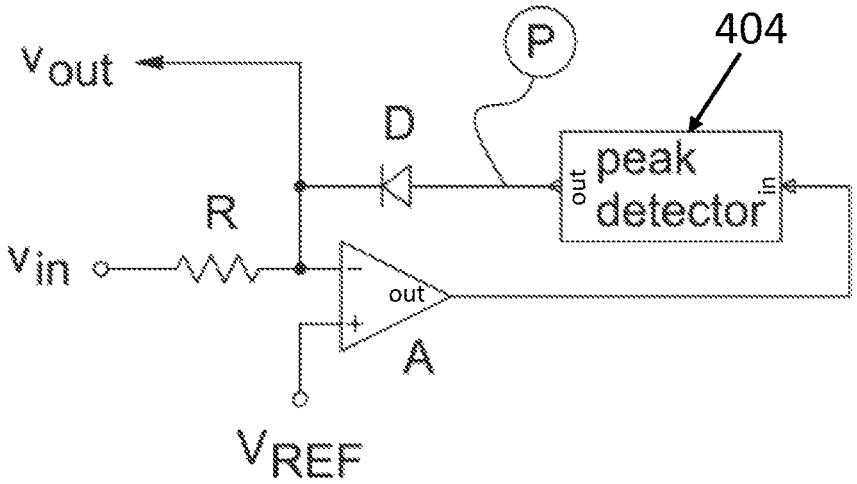
FIG. 4B is a diagram illustrating an exemplary negative-swing-limiting clamp, having a positive-swing peak detector in the feedback path of a voltage limiter in a super-diode configuration, according to some embodiments of the disclosure.
Figure 11:
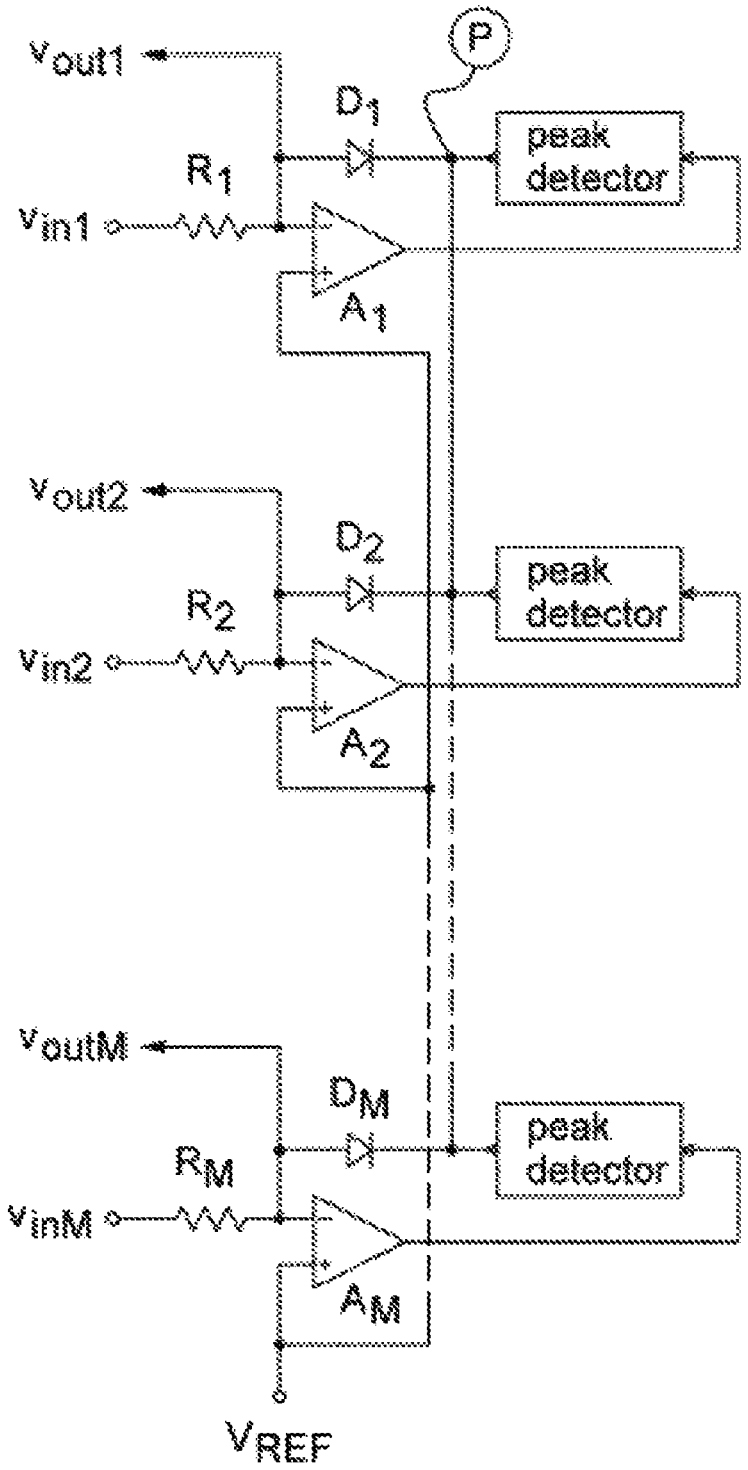
FIG. 11 is a diagram illustrating an exemplary multi-input positive-swing-limiting precision voltage clamp including M clamps of the type illustrated in FIG. 4A, whose peak detector outputs are directly connected, according to some embodiments of the disclosure.
Figure 12:
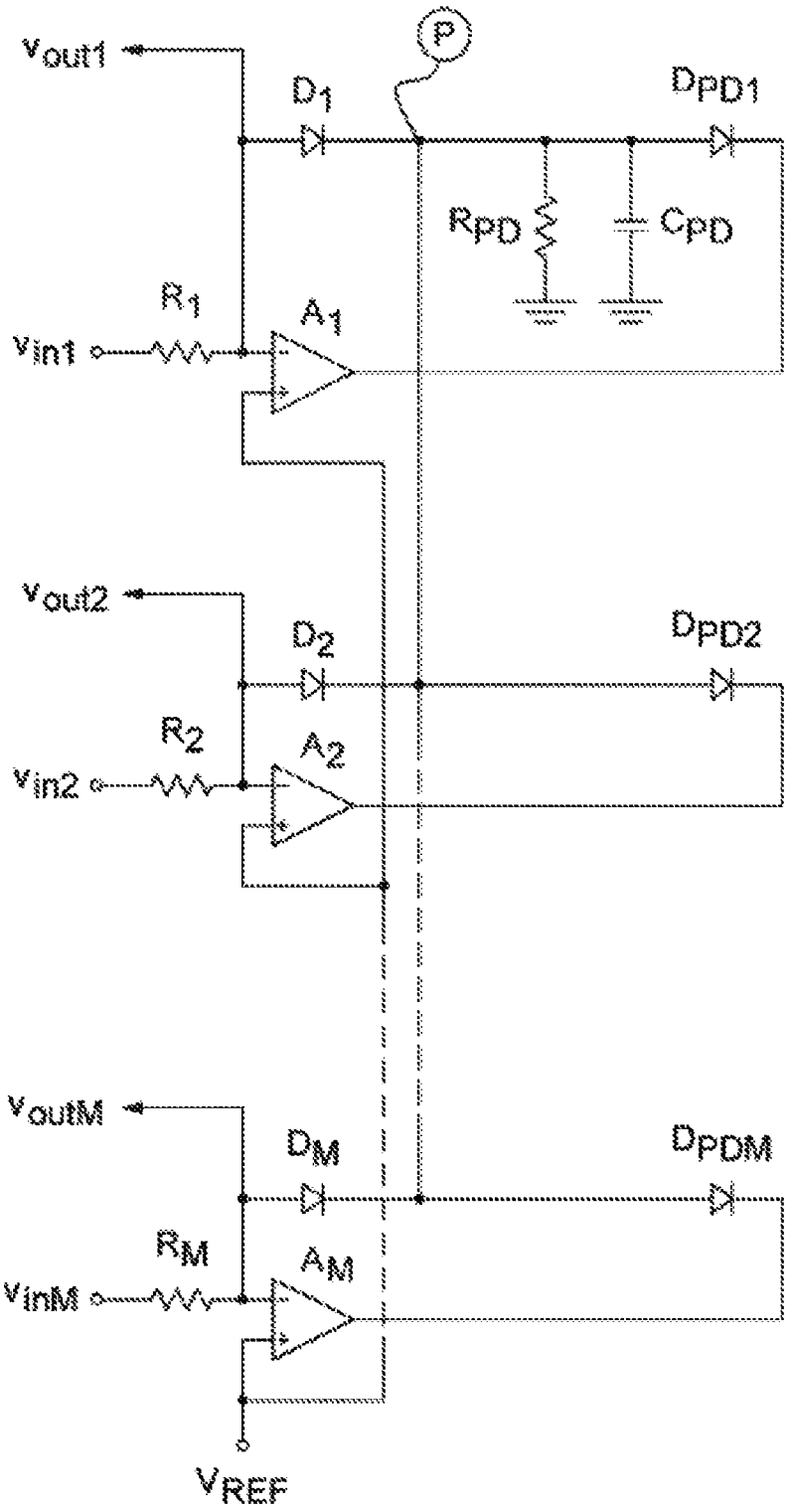
FIG. 12 is a diagram, detailing an implementation for the peak detector circuits in FIG. 11, having a common detection capacitor $C_{PD}$ and a common bleed resistor $R_{PD}$, according to some embodiments of the disclosure.
Figure 13A:
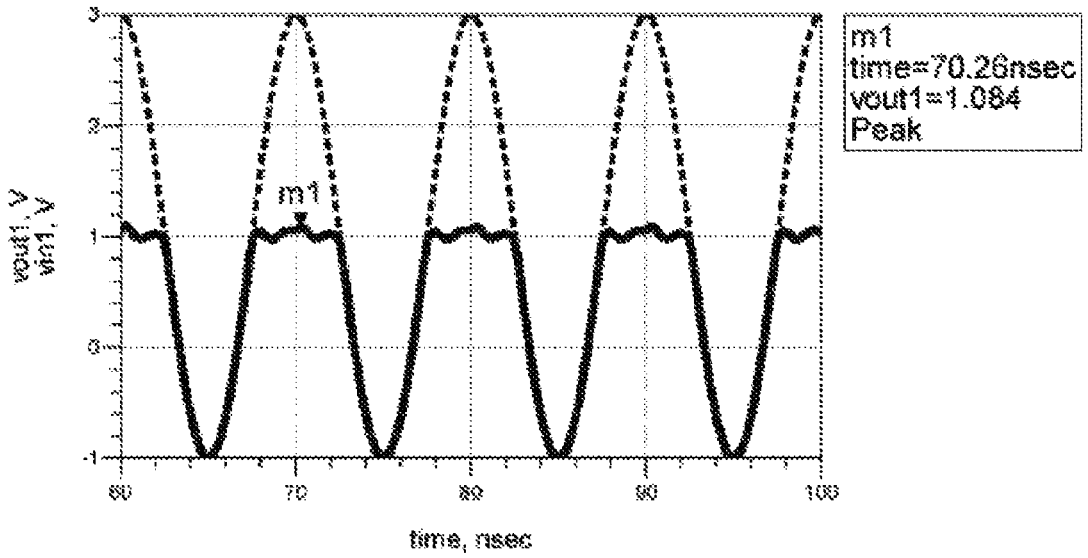
FIGS. 13A-D illustrate typical voltage outputs of the clamp of FIG. 12 (indicated with respective solid lines), when a moderate-frequency 4-phase sinusoidal voltage is applied to the inputs (indicated with respective solid lines), using an exemplary $V_{REF}$=1V, where $$v_{ink}(t) = V_{DC} + V_{IN} \cdot \sin\left[2\pi f_0\left(t + \frac{k-1}{Mf_0}\right) + \Phi_0\right],$$
Figure 13B:
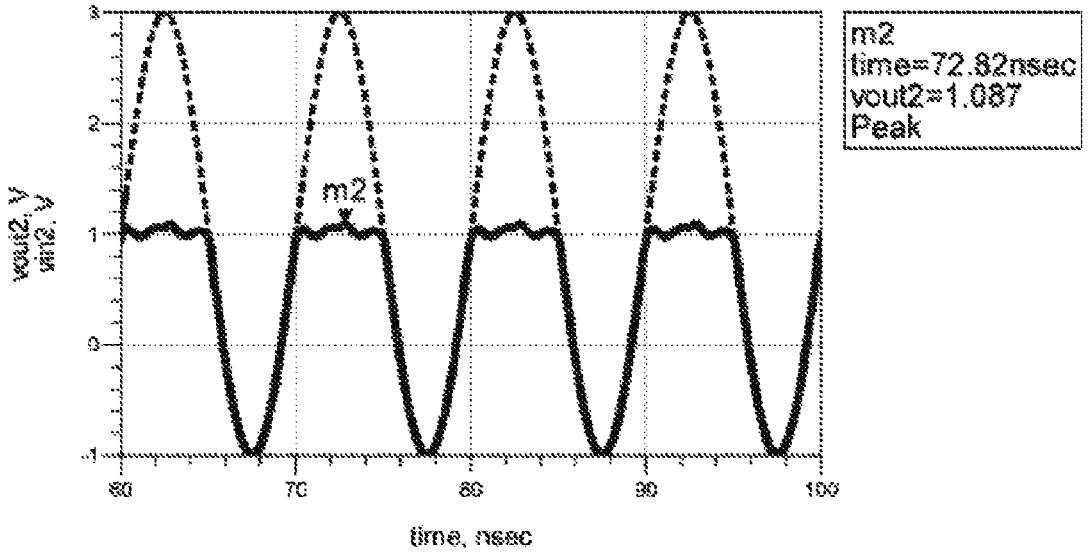
Figure 13C:
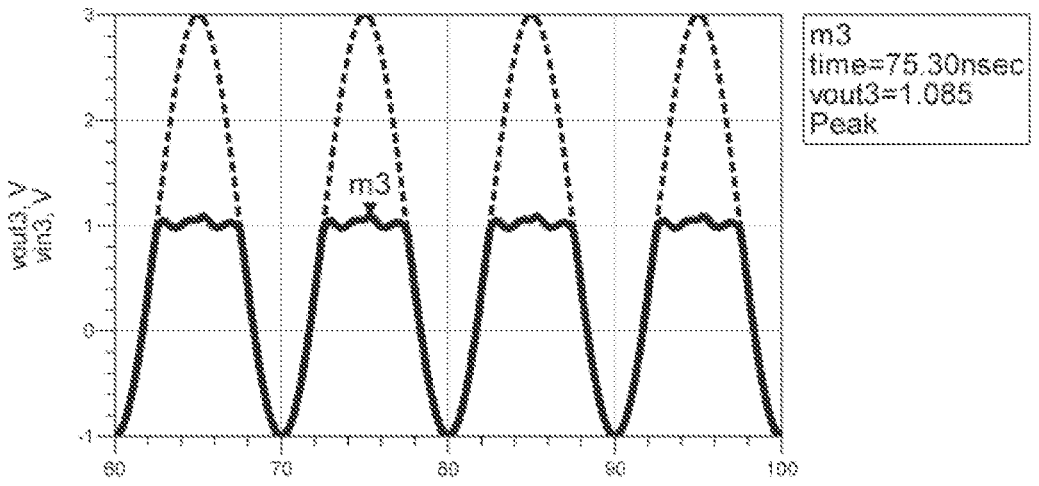
Figure 13D:
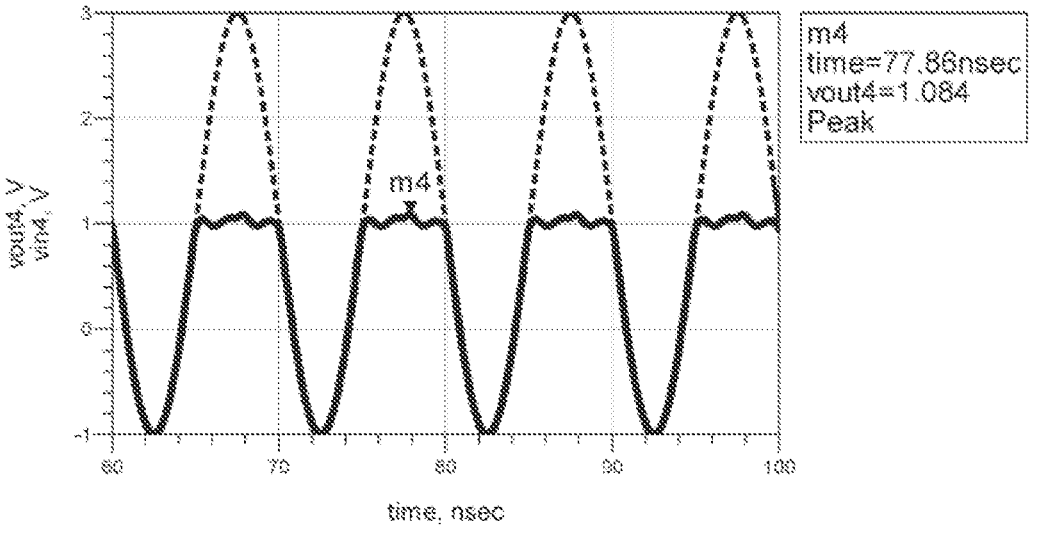
Figure 14A:
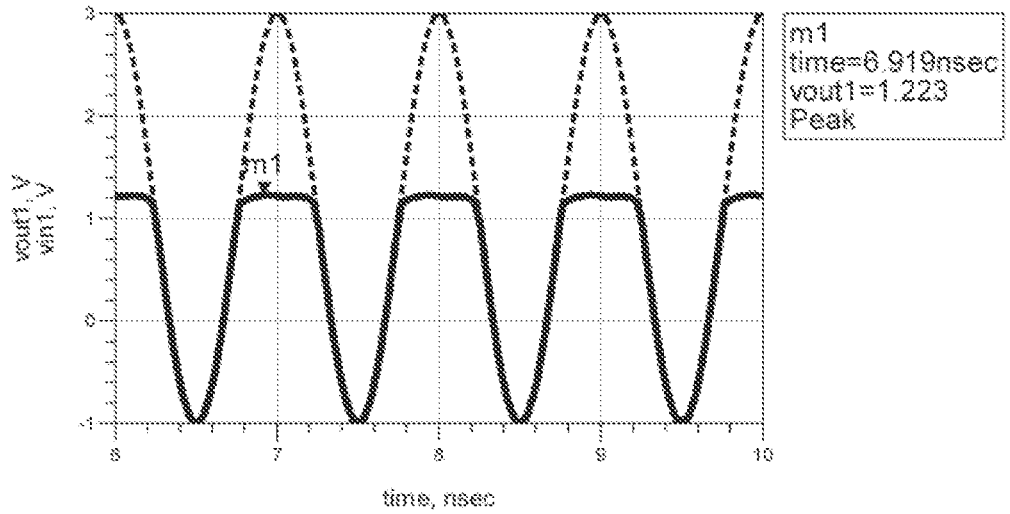
Figure 14B:
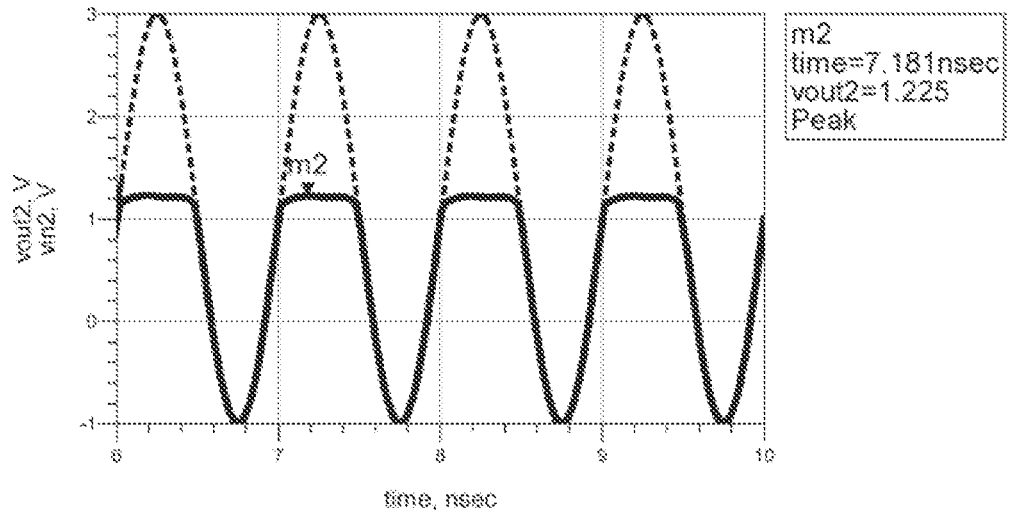
Figure 14C:
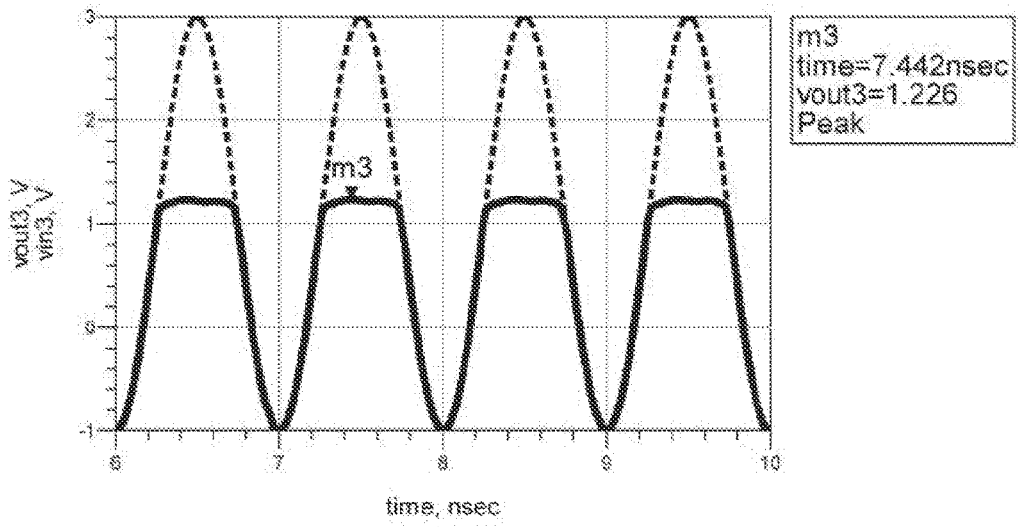
Figure 14D:
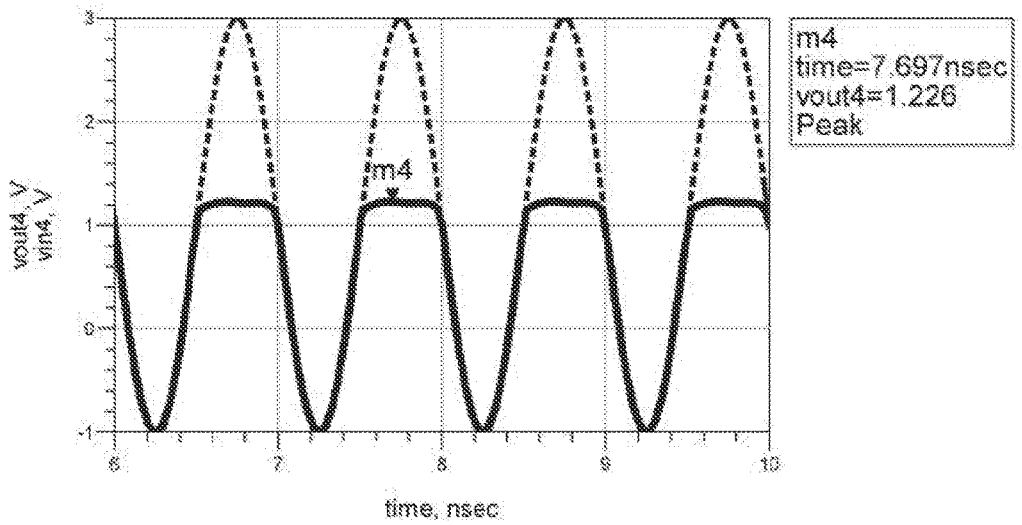
Figure 15A:
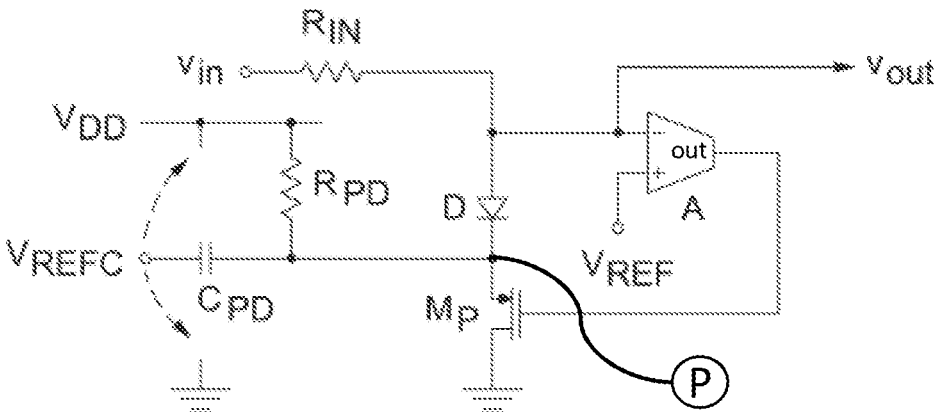
Figure 15B:
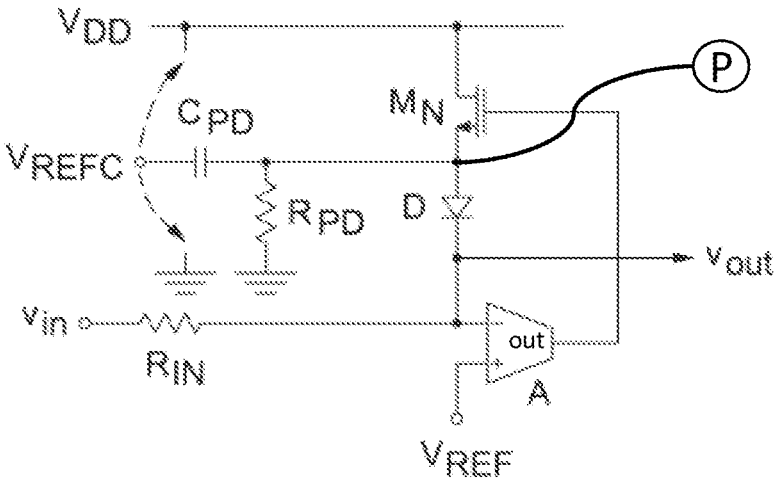
Figure 16:
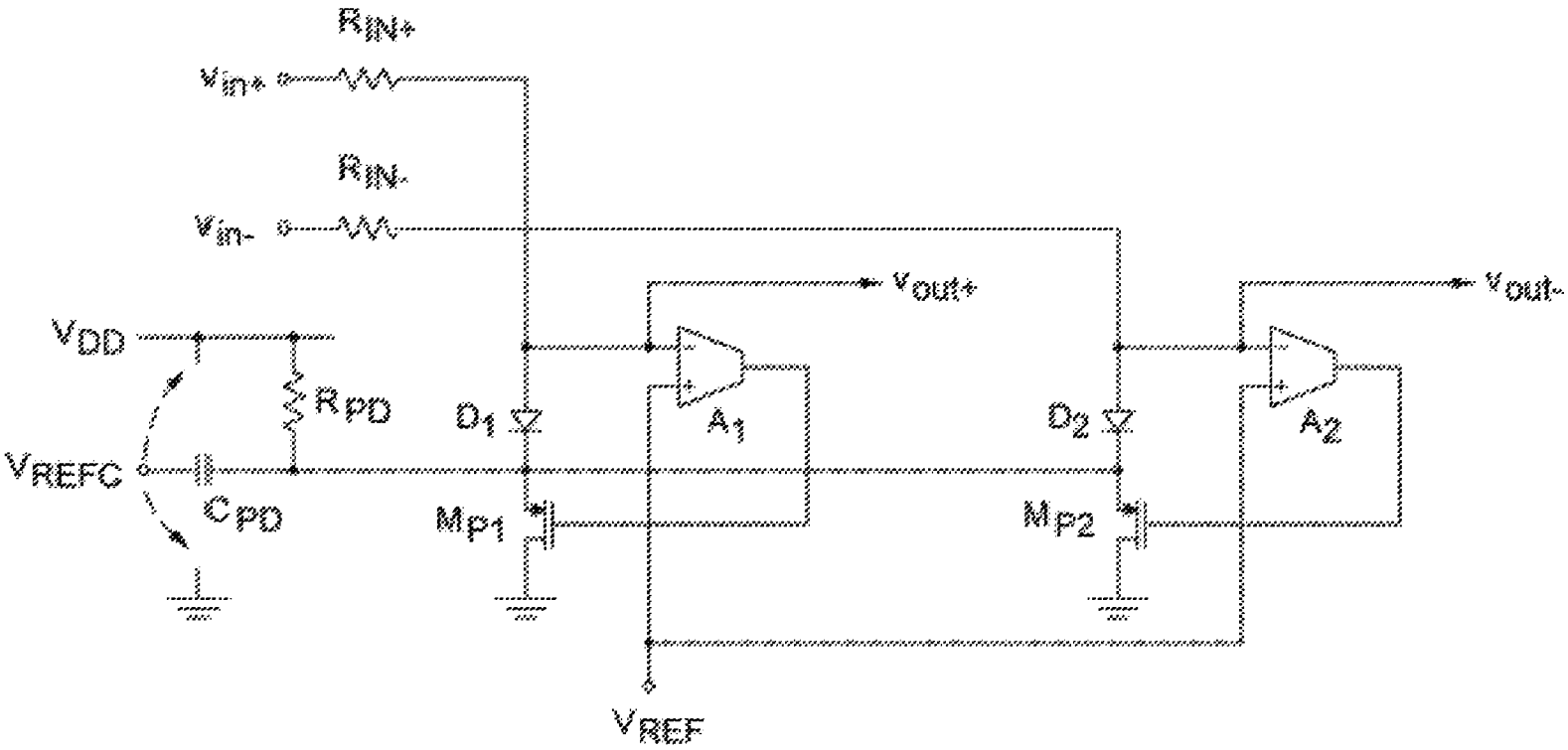
Figure 17:
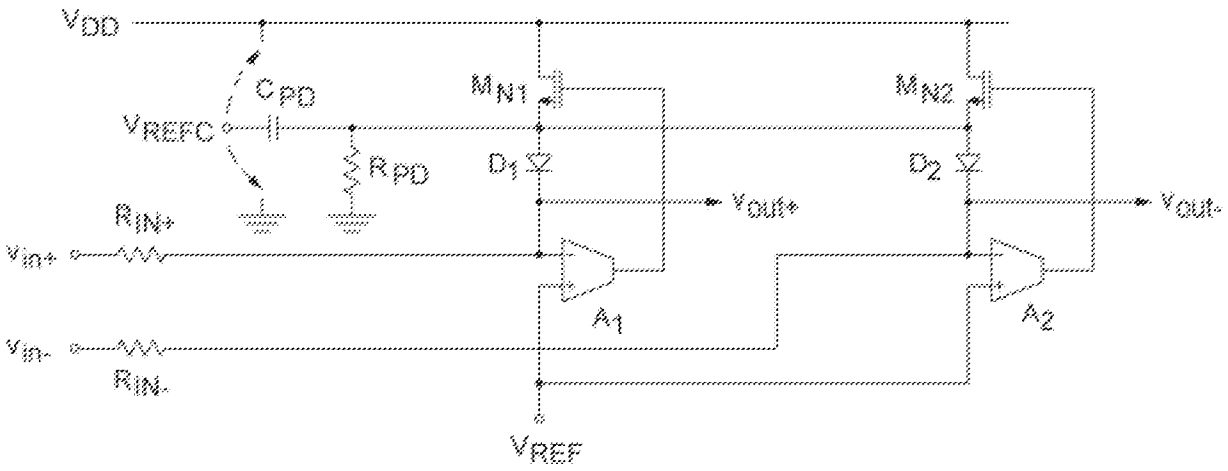
Figure 18:
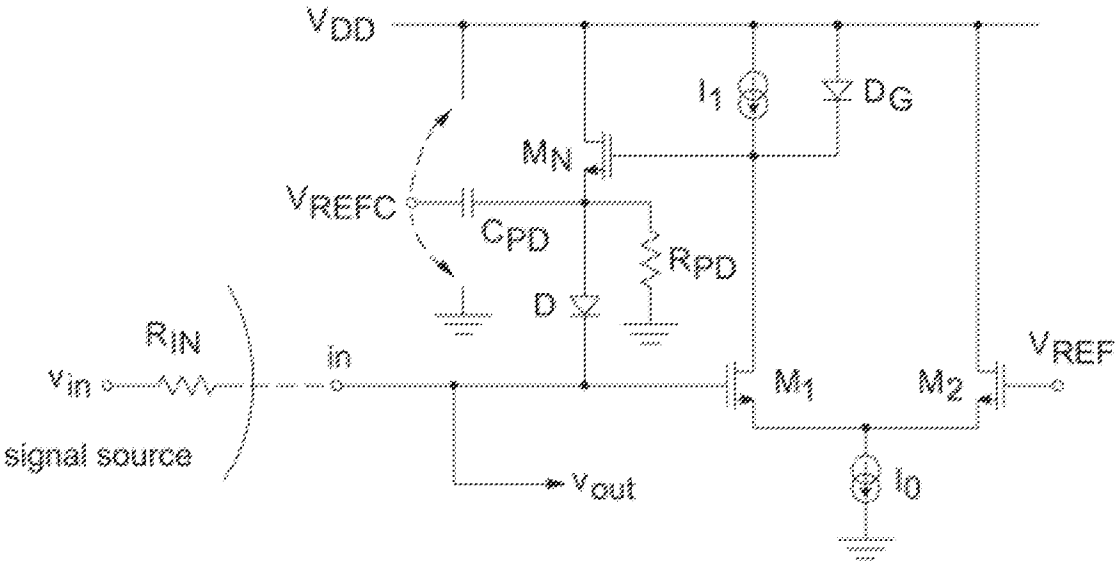
Figure 19:
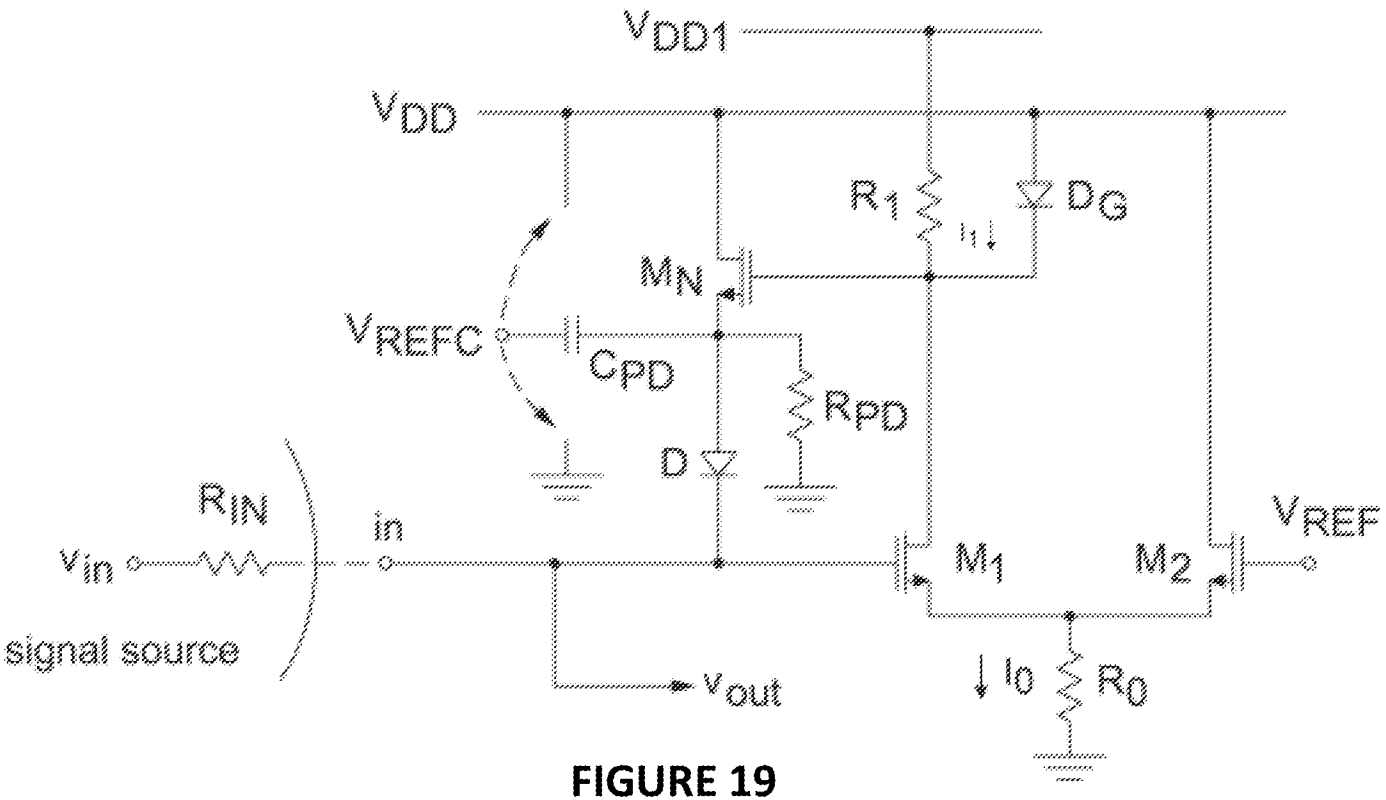
Figure 20:
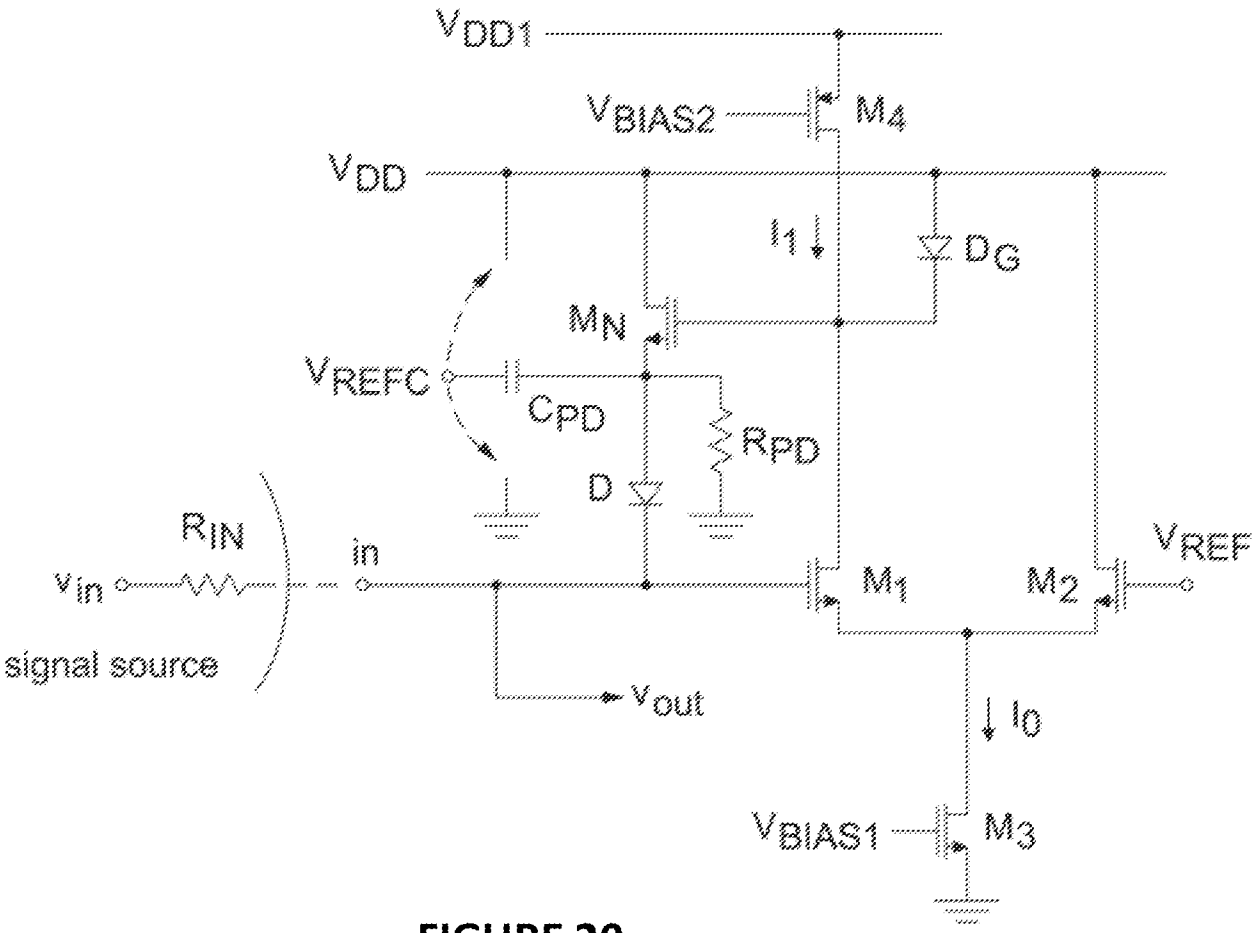
Figure 21:
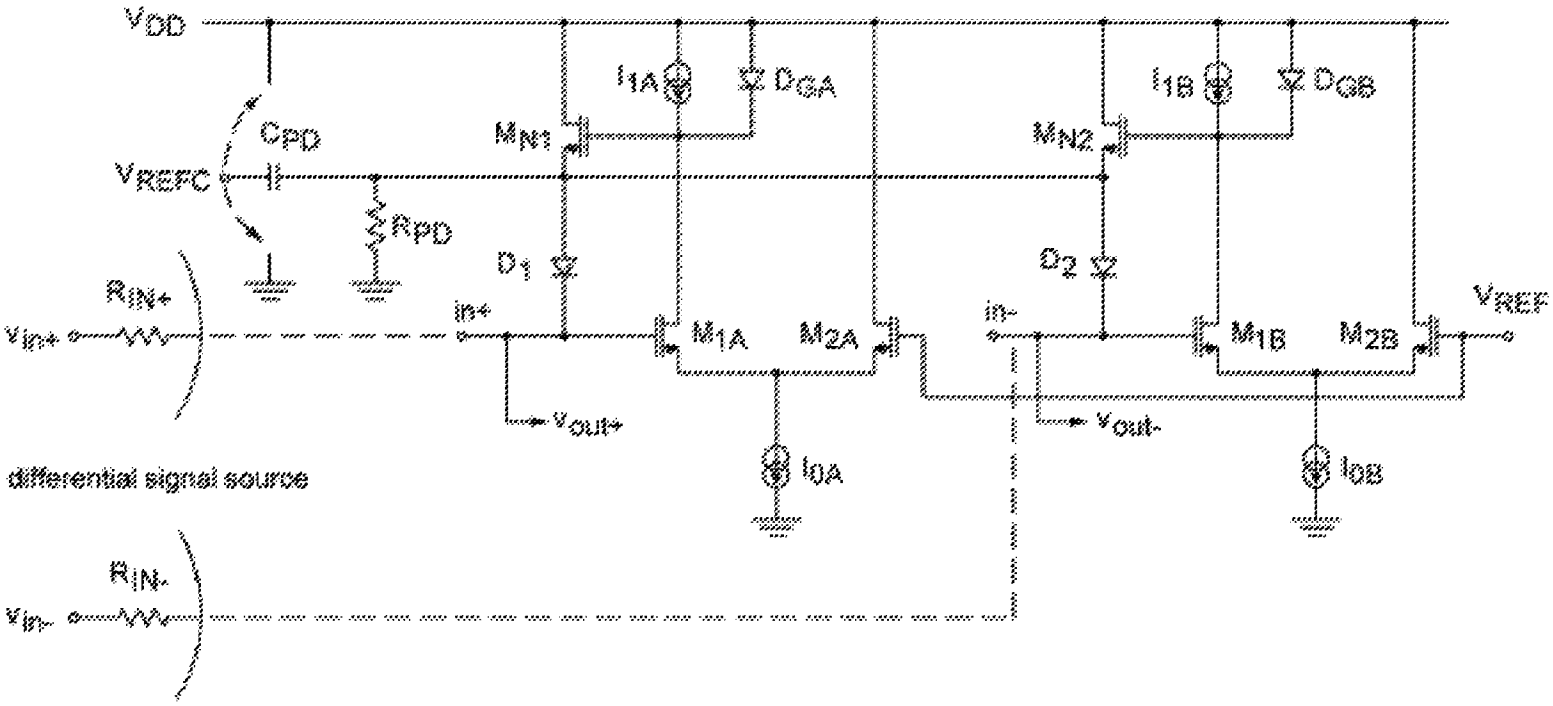
Figure 22:
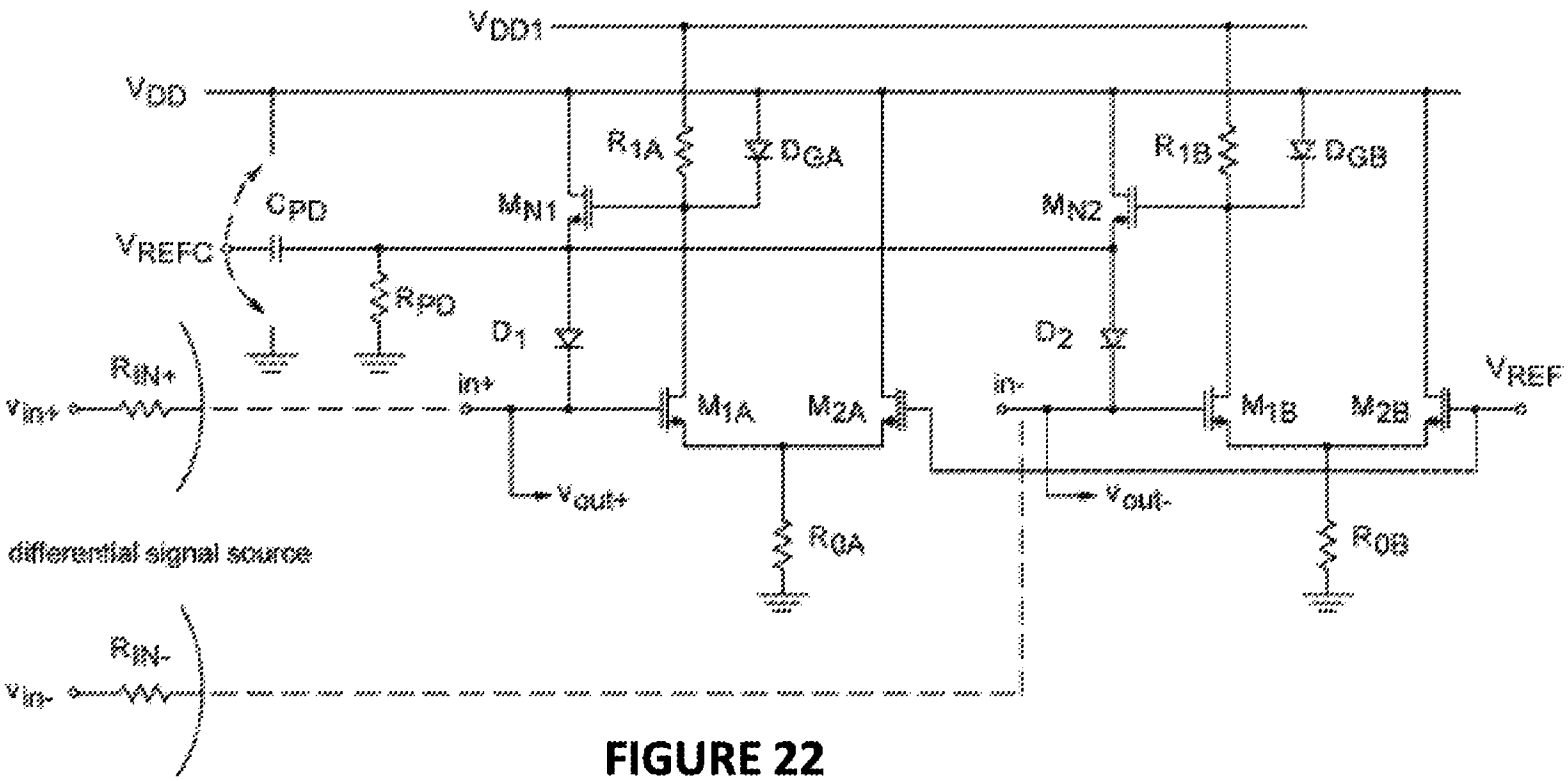
Figure 23:
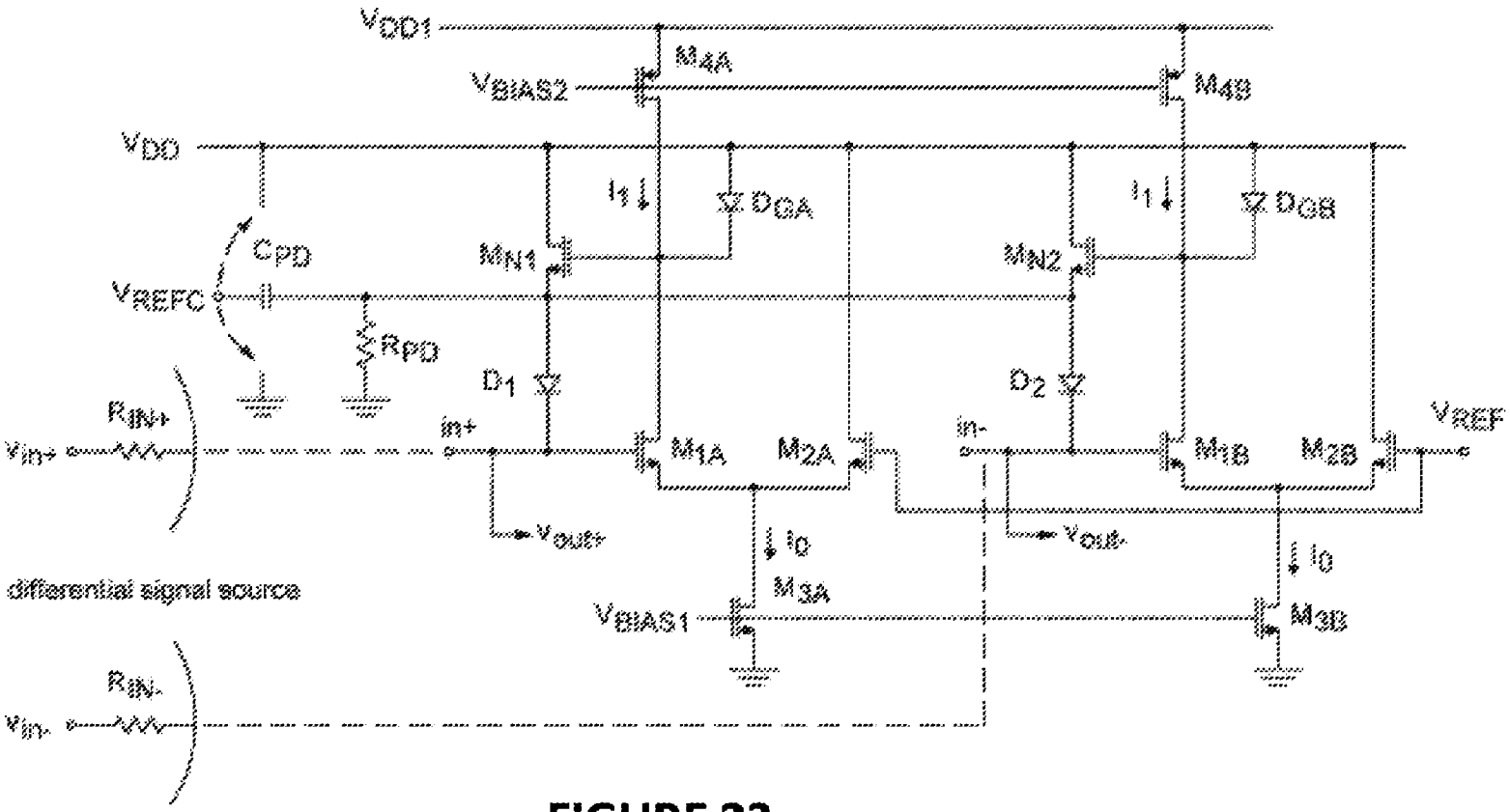
Figure 24A:
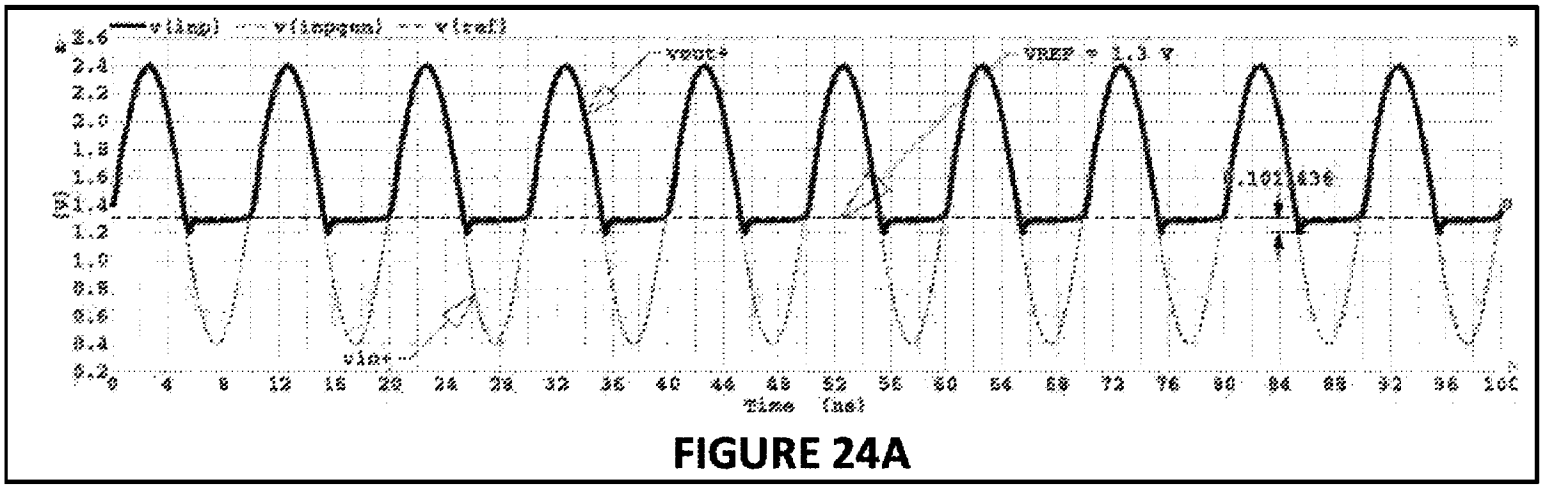
Figure 24B:
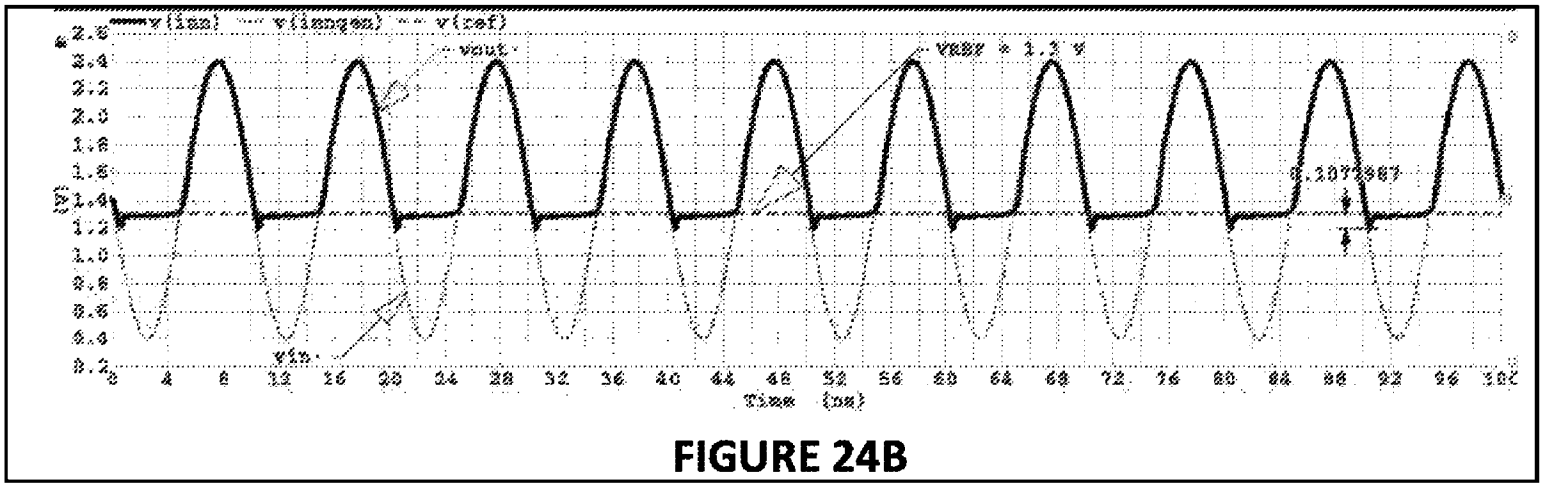
Figure 25A:
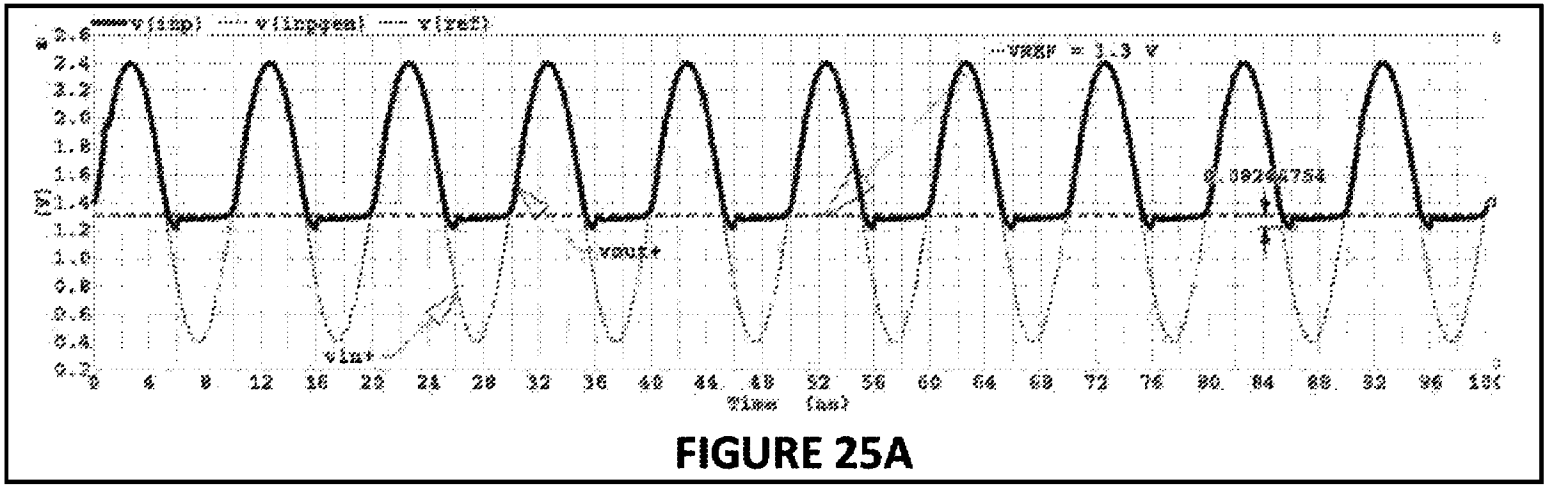
Figure 25B:
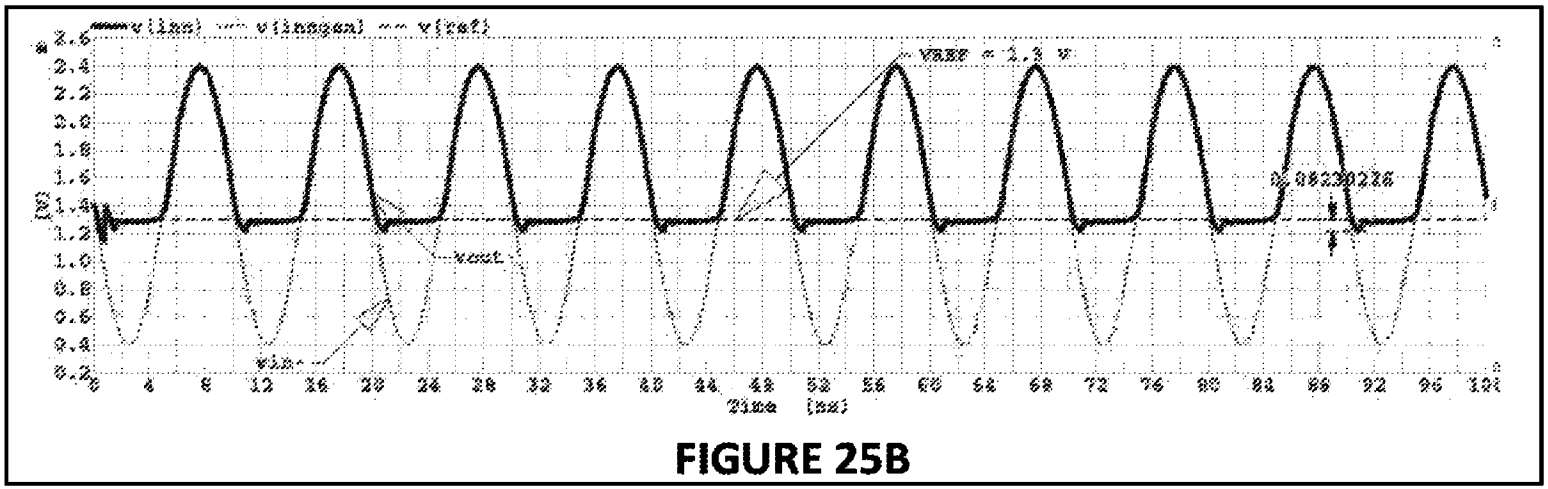
Figure 26A:
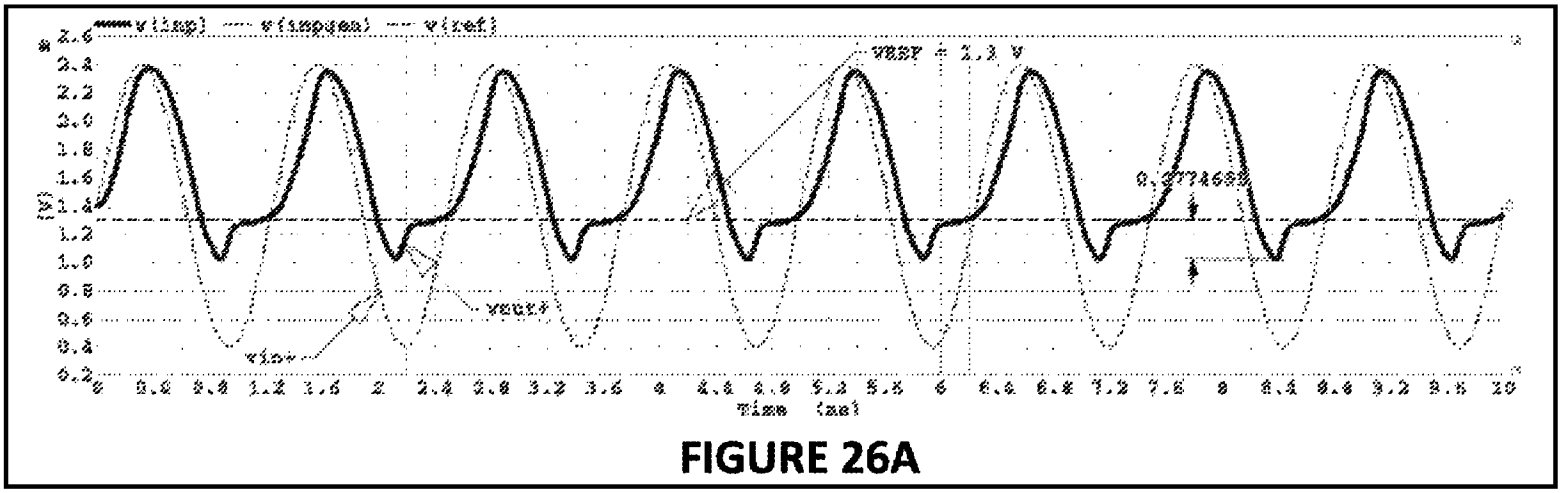
Figure 26B:
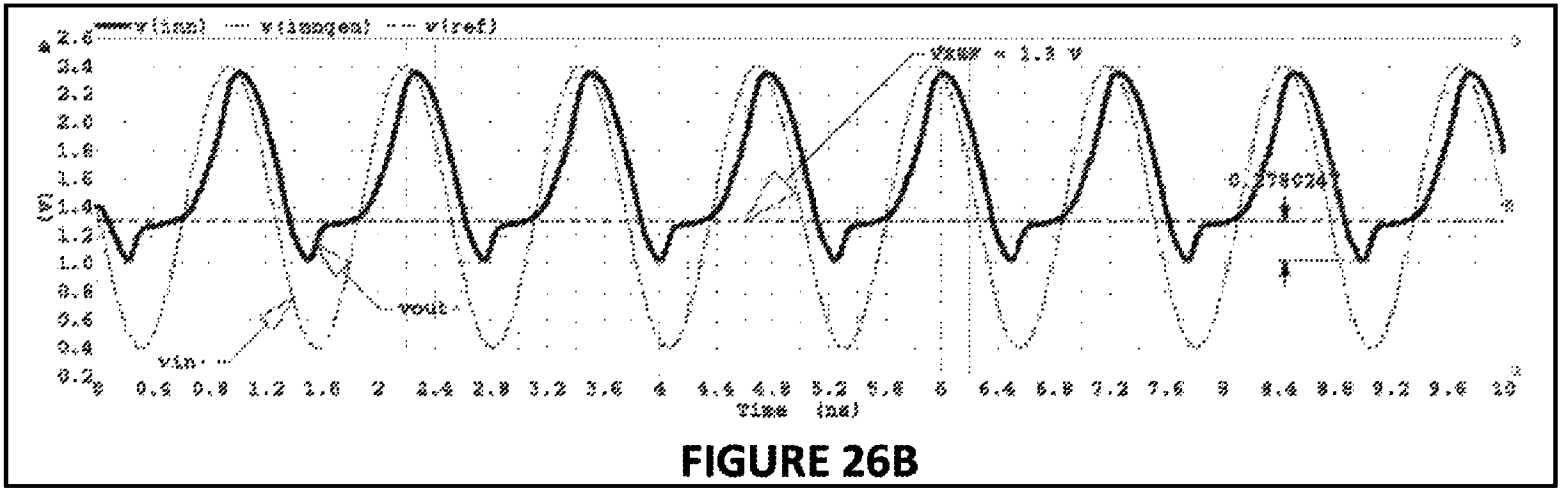
Figure 27A:
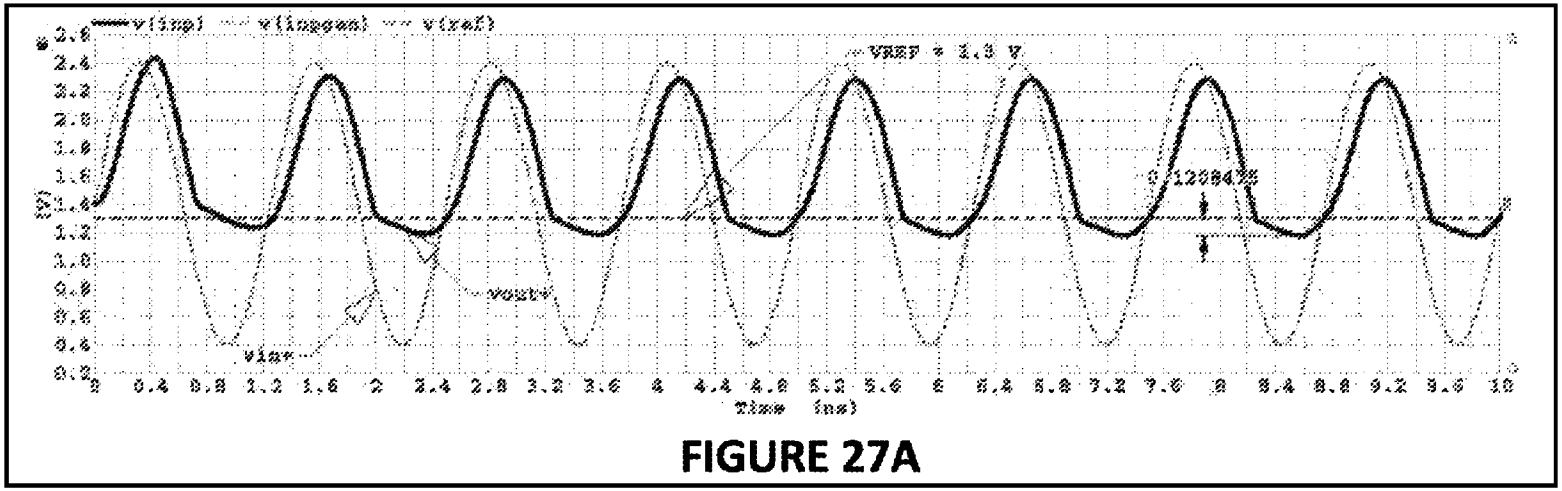
Figure 27B:
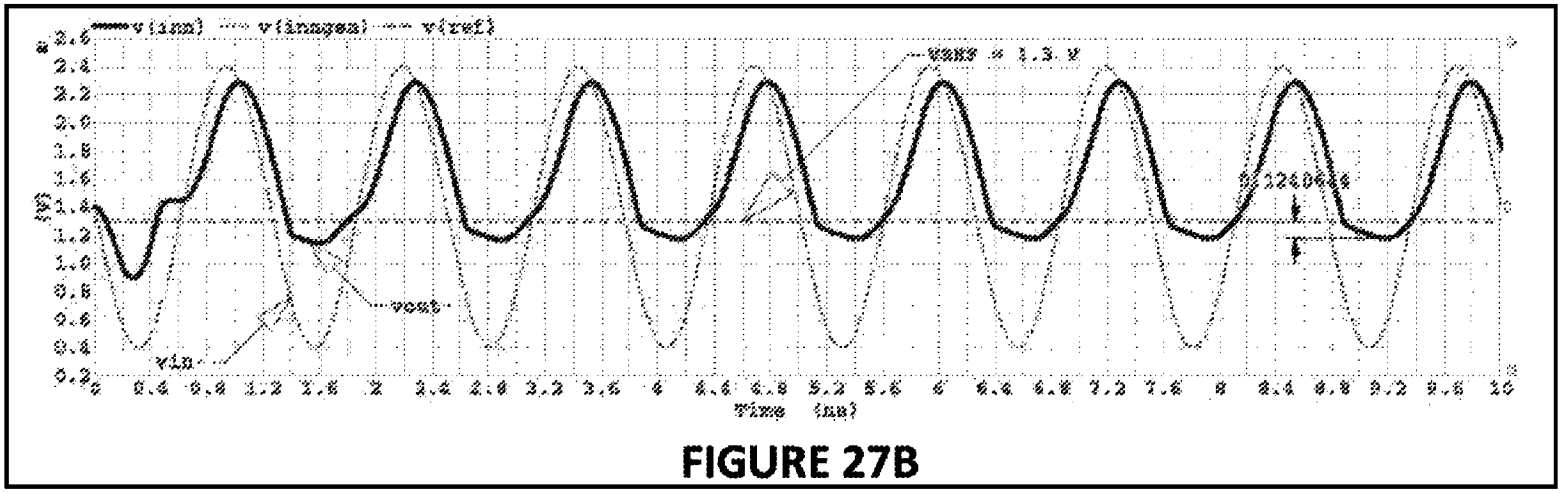
Figure 28:
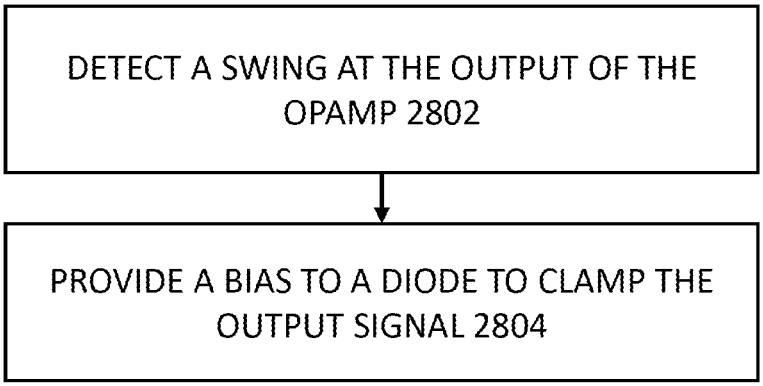

k=1, . . . , M=4; $V_{DC}$=1V; $V_{IN}$=2V and the moderate frequency is the same as in FIG. 3A, according to some embodiments of the disclosure;

FIGS. 14A-D illustrate typical voltage outputs of the clamp of FIG. 11 (solid lines), illustrates typical voltage outputs of the clamp of FIG. 12 (indicated with respective solid lines), when a high-frequency 4-phase sinusoidal voltage is applied to the inputs (indicated with respective solid lines), using an exemplary $V_{REF}$=1V, where $$v_{ink}(t) = V_{DC} + V_{IN} \cdot \sin\left[2\pi f_0\left(t + \frac{k-1}{Mf_0}\right) + \Phi_0\right],$$

k=1, . . . , M=4; $V_{DC}$=1V; $V_{IN}$=2V and the high frequency is the same as in FIG. 3B, according to some embodiments of the disclosure;

FIG. 15A is a diagram detailing an exemplary CMOS implementation of the clamp of FIG. 4A, according to some embodiments of the disclosure;

FIG. 15B is diagram detailing an exemplary CMOS implementation of the clamp of FIG. 4B, according to some embodiments of the disclosure;

FIG. 16 is a diagram detailing a CMOS implementation of a two-input positive-swing-limiting precision voltage clamp having two clamps of the type illustrated in FIG. 15A, whose peak detector outputs are directly connected, according to some embodiments of the disclosure;

FIG. 17 is a diagram illustrating yet another embodiment of the present invention, detailing a CMOS implementation of a two-input negative-swing-limiting precision voltage clamp comprised of two clamps of the type illustrated in FIG. 15B, whose peak detector outputs are directly connected, according to some embodiments of the disclosure;

FIG. 18 is a diagram illustrating an exemplary CMOS implementation of operational amplifier A in FIG. 15B, according to some embodiments of the disclosure;

FIG. 19 is a diagram detailing the use of resistors in lieu of current sources in FIG. 18, according to some embodiments of the disclosure;

FIG. 20 is a diagram detailing the use of MOS transistors for implementing the current sources in FIG. 18, according to some embodiments of the disclosure;

FIG. 21 is a diagram detailing an exemplary CMOS implementation of a pseudo-differential clamp for limiting negative voltage swings, according to some embodiments of the disclosure;

FIG. 22 is a diagram detailing an exemplary CMOS implementation of a pseudo-differential clamp for limiting negative voltage swings, using resistors in lieu of current sources in FIG. 21, according to some embodiments of the disclosure;

FIG. 23 is a diagram detailing an exemplary CMOS implementation of a pseudo-differential clamp for limiting negative voltage swings, using MOS transistors in lieu of current sources in FIG. 21, according to some embodiments of the disclosure;

FIGS. 24A-B illustrate the simulated input voltages (indicated with respective dotted lines) and output voltages (indicated with respective solid lines) for an actual CMOS realization of the clamp of FIG. 23, at a moderate input frequency of 100 MHz, using a reference clamping voltage $V_{REF}$=1.3V, with no peak detector capacitor present in the circuit ($C_{PD}$=0), according to some embodiments of the disclosure;

FIGS. 25A-B illustrate the simulated input voltages (indicated with respective dotted lines) and output voltages (indicated with respective solid lines) for an actual CMOS realization of the clamp of FIG. 23, at a moderate input frequency of 100 MHz, using a reference clamping voltage $V_{REF}$=1.3V, with the peak detector capacitor present in the circuit and connected to $V_{DD}$, according to some embodiments of the disclosure;

FIGS. 26A-B illustrate the simulated input voltages (indicated with respective dotted lines) and output voltages (indicated with respective solid lines) for an actual CMOS realization of the clamp of FIG. 23, at a high input frequency of 800 MHz, using a reference clamping voltage $V_{REF}$=1.3V, with no peak detector capacitor present in the circuit $C_{PD}$=0), according to some embodiments of the disclosure;

FIGS. 27A-B illustrates the simulated input voltages (indicated with respective dotted lines) and output voltages (indicated with respective solid lines) for an actual CMOS realization of the clamp of FIG. 23, at a high input frequency of 800 MHz, using a reference clamping voltage $V_{REF}$=1.3V, with the peak detector capacitor present in the circuit and connected to $V_{DD}$, according to some embodiments of the disclosure; and FIG. 28 is a flow diagram illustrating a method for limiting an input signal and producing a limited output signal with respect to a reference voltage.

DESCRIPTION OF EXAMPLE EMBODIMENTS OF THE DISCLOSURE

Understanding Clamping Circuits and Various Implementations Thereof

Voltage limiters (also referred herein as clamping circuits, voltage clamps, or amplitude limiters) can have various designs. Some design factors include speed and accuracy. Speed relates to how quickly the clamp can respond to an input overvoltage. Accuracy relates to how precise the voltage is limited at the prescribed level in overvoltage conditions.

There is a need for precise, high-frequency voltage clamps in modern integrated circuits, where high-speed transistors operating with otherwise small headroom voltages are the only choice for delivering high-linearity performance, but at the same time are in danger of being destroyed by the output signals exceeding the transistor breakdown voltage.

Some conventional voltage limiters uses bipolar diodes. While bipolar diodes implementations can be fast and can be accommodated in more complex circuitry, these implementations are not very accurate, tend to be temperature-sensitive, and the limiting voltage can be set only in multiples of one diode voltage.

Some conventional implementations can leverage complementary metal-oxide-semiconductor (CMOS) transistor threshold voltages to provide voltage limiting. Such single-ended amplitude limiters are not very fast and the limiting voltage can be inaccurate due to the inaccuracy of the CMOS transistor threshold voltages. One could provide implementations that leverage the faster response of bipolar junction transistors (BJTs), but the resulting voltage limiters remain fairly inaccurate.

Some conventional implementation involving an automatic gain control (AGC) loop operating as a single-ended voltage limiter is relatively accurate, but can be slow, expensive, and not easily usable in overvoltage protection schemes due to its configuration. Specifically, these limiters based on sample-and-hold can be slow due to the presence of the holding capacitor. Furthermore, the limiter requires an absolute-value detector whose precision can be difficult to achieve at high frequencies. Moreover, the limiter is not easily usable for over voltage protection due to its configuration.

Shortcomings of the Clamping Circuit with the Super Diode Configuration

Figure 1A:
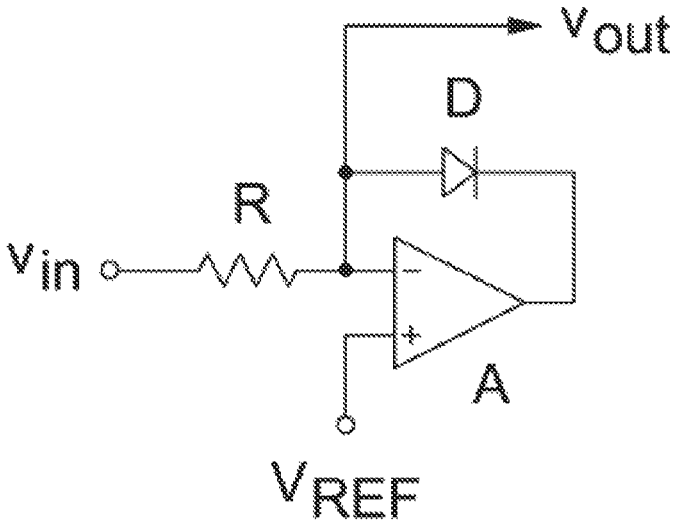
FIGURE 1A (PRIOR ART)
FIG. 1A is a diagram illustrating a conventional positive-swing-limiting precision voltage clamp, using the super-diode configuration.
Figure 1B:
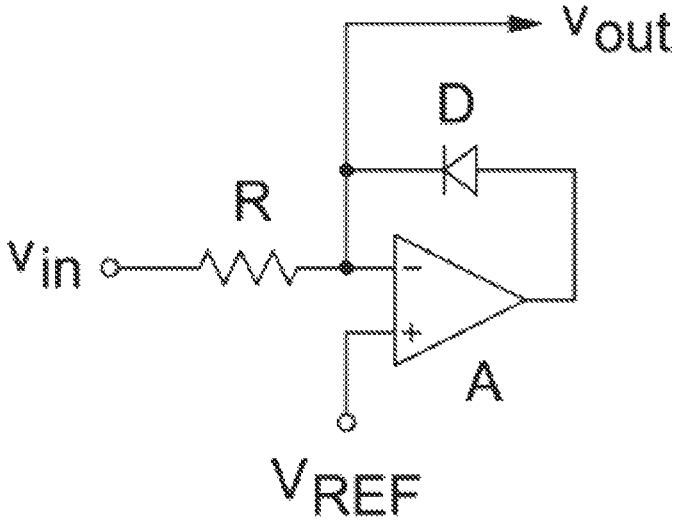
FIGURE 1B (PRIOR ART)
FIG. 1B is a diagram illustrating a conventional negative-swing-limiting clamp similar to the clamp of FIG. 1A.

One group of conventional voltage limiters includes a super-diode, or referred herein as a voltage limiter having a super-diode configuration (in some cases, the super-diode is also known as a precision rectifier circuit). Broadly speaking, the voltage limiter uses an operational amplifier (opamp) as a comparator, where an input signal is compared against a reference voltage. The output of the opamp drives a diode configured in the negative feedback path of the opamp. FIG. 1A is a diagram illustrating a conventional positive-swing-limiting precision voltage clamp, using the super-diode configuration. As shown, a diode D is connected in the negative feedback path of opamp A (a path from the output of the opamp to the inverting input of the opamp). The input voltage $v_{in}$ is applied to a resistor R connected to the inverting input of A. If the operational amplifier is ideal, for input voltages $v_{in} \leq V_{REF}$, where $V_{REF}$ is a reference voltage connected to the non-inverting input of the opamp, the output of A swings high and reverse-biases D, causing output voltage $v_{out}$ to follow $v_{in}$($v_{out}=v_{in}$). If $v_{in}>V_{REF}$, the opamp output swings low, and forward-biases D, and forces $v_{out}$ to become equal to $V_{REF}$($v_{out}=V_{REF}$). In this way, the output voltage $v_{out}$ is clamped to reference $V_{REF}$. FIG. 1B is a diagram illustrating a conventional negative-swing-limiting clamp similar to the clamp of FIG. 1A, but the polarity of D is flipped. It can be shown in the same way that $v_{out}$ is clamped at $V_{REF}$ when $v_{in}<V_{REF}$, and follows $v_{in}$ when $v_{in} \geq V_{REF}$.

Figure 2A:
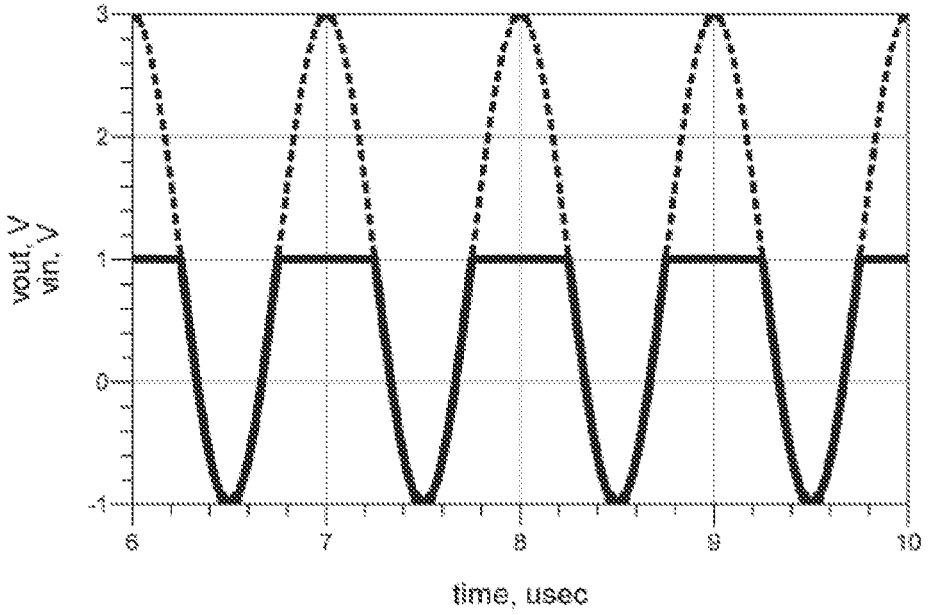
FIGURE 2A (PRIOR ART)
FIG. 2A illustrates a typical voltage output of the clamp of FIG. 1A (indicated with a solid line), when a low-frequency (10 MHz or lower) sinusoidal voltage having a DC component is applied to the input (indicated with dotted line), using an exemplary $V_{REF}$=1V.
Figure 2B:
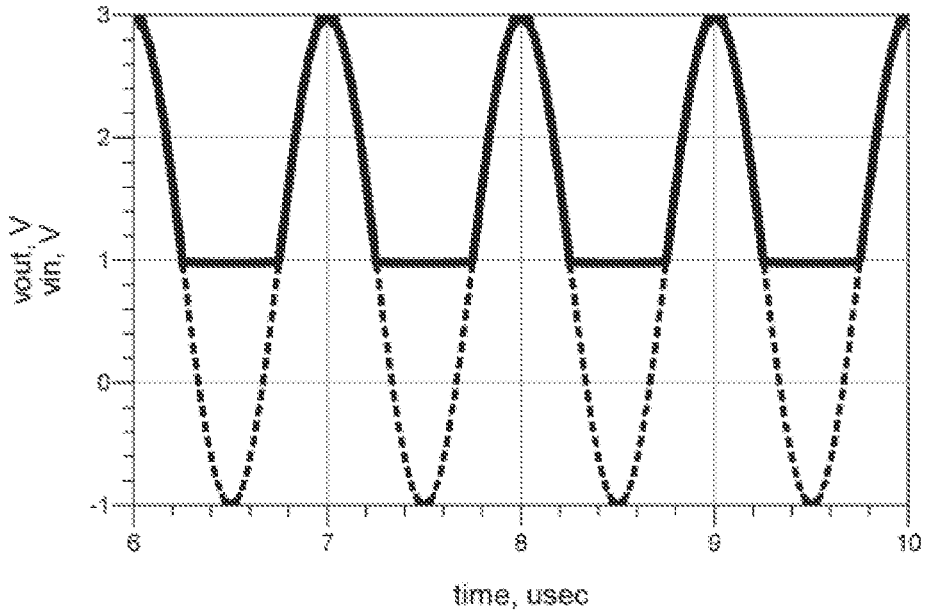
FIGURE 2B (PRIOR ART)
FIG. 2B illustrates a typical voltage output of the clamp of FIG. 1B (indicated with a solid line), when a low-frequency (10 MHz or lower) sinusoidal voltage having a DC component is applied to the input (indicated with a dotted line), using the same exemplary $V_{REF}$=1V.

Assuming an ideally-fast opamp A, or an input frequency $f_0$ much lower than the unity-gain frequency of A, the clamping action is rather good. FIG. 2A illustrates a typical voltage output of the clamp of FIG. 1A (indicated with a solid line), when a low-frequency (10 MHz or lower) sinusoidal voltage having a DC component is applied to the input (indicated with dotted line), using an exemplary $V_{REF}$=1V. FIG. 2B illustrates a typical voltage output of the clamp of FIG. 1B (indicated with a solid line), when a low-frequency (10 MHz or lower) sinusoidal voltage having a DC component is applied to the input (indicated with a dotted line), using the same exemplary $V_{REF}$=1V. The $v_{in}$ for both plots is of the form $v_{in}=V_{DC}+V_{IN}\cdot\sin[2\pi f_0 t+\Phi_0]$, with $V_{DC}$=1V, and $V_{IN}$=2V. It can be observed from the plots of FIGS. 2A-B that the limited output signal is clamped accurately at the reference voltage.

Figure 3A:
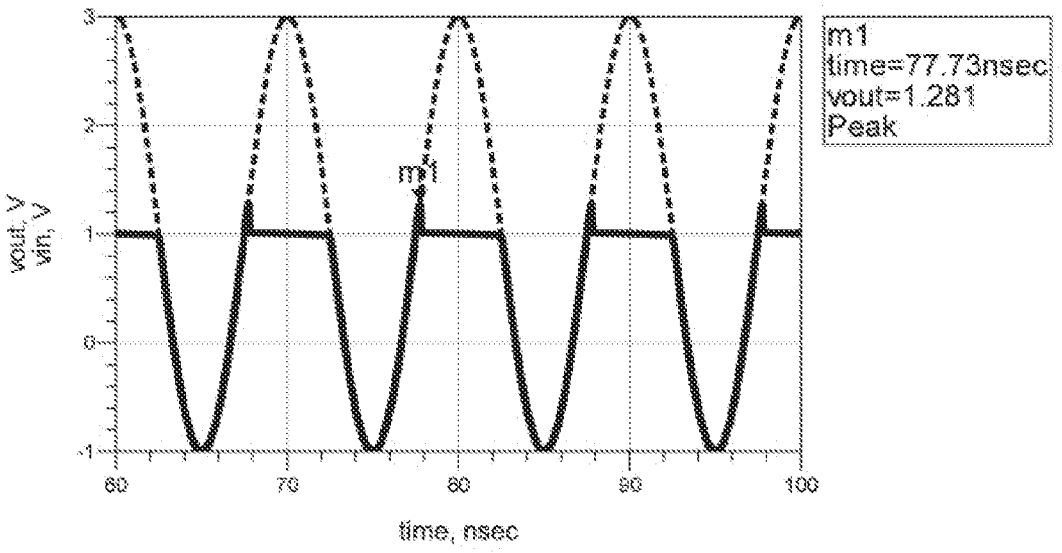
FIGURE 3A (PRIOR ART)
FIG. 3A illustrates a typical voltage output of the clamp of FIG. 1A (indicated with a solid line), when a moderate-frequency (10-100 MHz) sinusoidal voltage having a DC component is applied to the input (indicated with a dotted line), using an exemplary $V_{REF}$=1V.
Figure 3B:
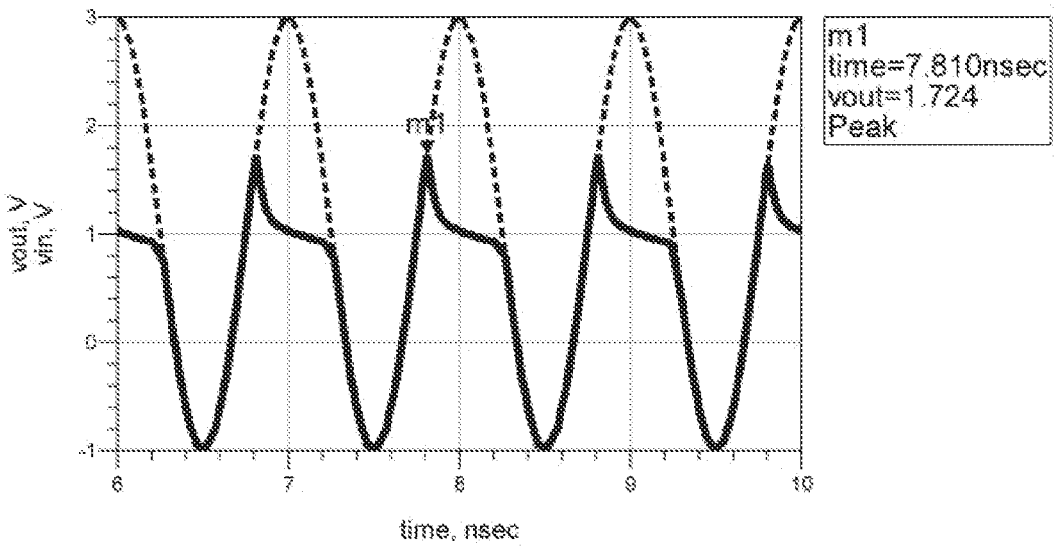
FIGURE 3B (PRIOR ART)
FIG. 3B illustrates a typical voltage output of the clamp of FIG. 1A (indicated with a solid line), when a high-frequency (>100 MHz) sinusoidal voltage having a DC component is applied to the input (indicated with a dotted line), using an exemplary $V_{REF}$=1V.

While the circuits of FIGS. 1A-B can be very accurate at low frequencies (as seen in FIGS. 2A-B), the accuracy of the circuit begins to suffer as the input frequency increases. FIG. 3A illustrates a typical voltage output of the clamp of FIG. 1A (indicated with a solid line), when a moderate-frequency (10-100 MHz) sinusoidal voltage having a DC component is applied to the input (indicated with a dotted line), using an exemplary $V_{REF}$=1V. It can be seen at this moderate frequency, an overshoot is present for positive input edges, where the output voltage shoots over the reference voltage before it is clamped at the reference voltage. In this example where the input frequency is 100 MHz, the marker on the plot shows the output voltage reaches around 1.281 V, an overshoot of 0.281 V above $V_{REF}$=1V). FIG. 3B illustrates a typical voltage output of the clamp of FIG. 1A (indicated with a solid line), when a high-frequency (>100 MHz) sinusoidal voltage having a DC component is applied to the input (indicated with a dotted line), using an exemplary $V_{REF}$=1V. It can be seen at this high frequency, the problem of overshoot is more pronounced. In this example where the input frequency is 1 GHz, the marker on the plot shows the output voltage reaches around 1.724V, an overshoot of 0.724 V above $V_{REF}$=1V. The problem of undershoot is also present for the clamp of FIG. 1B. Such accuracy problem, i.e., undesirable voltage overshoot for positive-swing-limiting clamps and undesirable undershoot for negative-swing-limiting clamps, can be attributed to the finite response time of the opamp. In other words, the speed at the output of the opamp contributes to the diode not working fast enough to clamp the output voltage to the reference voltage. In cases where such clamps are intended for protecting circuit components such as transistor from breakdown, the clamping overshoot or undershoot can be problematic at high frequencies, rendering the clamp ineffective.

An Improved Voltage Limiter: A High-Speed Precision Clamping Circuit

A high-speed precision clamp is disclosed. The clamp can be advantageously implemented in integrated-circuit technologies. The clamping action is unidirectional, in the sense that, depending on how the circuit is configured, the output voltage of each clamping branch ideally does not swing above or below a certain reference voltage. The precision of the clamping voltage, clamp response time, and minimum overshoot (for positive-swing-limiting) or undershoot (for negative-swing-limiting) are important characteristics of the present clamp, which are achieved using a unique configuration. This configuration exploits the advantages of the known super-diode architecture as shown in FIGS. 1A-B, which uses a diode in the negative feedback path of an operational amplifier for precision, and improves upon this architecture by adding a feedback peak detector in the negative feedback path for reducing the effects of the finite response time of the operational amplifier at high input frequencies.

FIG. 4A is a diagram illustrating an exemplary positive-swing-limiting precision voltage clamp having an additional negative-swing peak detector in the feedback path of voltage limiter in a super-diode configuration, according to some embodiments of the disclosure. FIG. 4B is a diagram illustrating an exemplary negative-swing-limiting clamp, having a positive-swing peak detector in the feedback path of a voltage limiter in a super-diode configuration, according to some embodiments of the disclosure. The voltage limiter in these two FIGURES are configured for limiting an input signal $v_{in}$ and producing a limited output signal $v_{out}$ with respect to a reference voltage $V_{REF}$.

The voltage limiter includes an opamp A. Specifically, the operational amplifier (opamp) has the reference voltage $V_{REF}$ connected to the non-inverting input of the opamp (indicated by the + symbol), and the input signal applied to a first resistor R connected to the inverting input of the opamp (indicated by the − symbol). In the super-diode configuration, the opamp A has a negative feedback path connecting the output of the opamp (indicated by "out") to the inverting input of the opamp.

The limiter in FIG. 4A further includes a first diode D in the negative feedback path, wherein a first terminal of the first diode D (the anode of D) provides the limited output signal. Completing the negative feedback path, the inverting input at the opamp is connected to the anode of D. The limited output signal is taken at a node which connects the first terminal of the first diode D (i.e., the anode of D) and the inverting input of the opamp. To provide a negative-swing-limiting clamp, the first diode D of FIG. 4B has the opposite/reversed polarity of the first diode D of FIG. 4A. A first terminal of the first diode D (the cathode of D) provides the limited output signal. Completing the negative feedback path, the inverting input at the opamp is connected to the cathode of the D. The limited output signal is taken at a node which connects the first terminal of the first diode D (i.e., the cathode of D) and the inverting input of the opamp A.

The resistor R, diode D, and opamp A of FIGS. 4A-B provide the same roles as their counterparts in FIGS. 1A-B. The improvement of the voltage limiters shown in FIGS. 4A-B lies with the peak detector 402 of FIG. 4A and peak detector 404 of FIG. 4B in the negative feedback path. The input node of the peak detector (indicated by "in") is connected to the output of the opamp, and the output node of the peak detector (indicated by "out") is connected to a second terminal of the first diode (i.e., the cathode of the first diode). The peak detector is configured to detect a swing at the output of the opamp and provide a bias to the second terminal of the first diode when the swing is detected.

The peak detector provides an important function for alleviating the issue of the finite response time of the opamp by reducing the burden of fast-switching for closing the feedback loop under input overvoltage conditions $v_{in}>V_{REF}$ (for a positive-swing-limiter) or undervoltage conditions $v_{in}<V_{REF}$ (for a negative-swing limiter). Specifically, the output of the peak detector (shown as node P) at high input frequencies can be assumed slowly-varying or constant relative to the input signal. Because the second terminal of the first diode connected to the output node of the peak detector is held practically at a constant voltage at high frequencies, the clamping function of the voltage limiter is ensured mainly by the first diode and the first (input) resistor R, where the opamp A and the peak detector ensure only a relatively stable bias for the second terminal of D. Consequently, the clamping overshoot voltage is reduced relative to the situation where the peak detector is not present in the circuit, because the contribution of the opamp response is reduced.

For the limiter shown in FIG. 4A, where the voltage limiter clamps the limited output signal when the voltage of the input signal is greater than the reference voltage (i.e., a positive-swing-limiter), the peak detector detects a negative swing at the output of the opamp, and the output node of the opamp produces a bias which forward-biases the first diode D. The resulting limiter is faster and more accurate than the limiter shown in FIG. 1A. When there is a negative swing at the output of the opamp, the opamp output indicates that the input signal $v_{in}>V_{REF}$. The peak detector 402 detects the negative swing (i.e., output of opamp swings low) and forward-biases D. As a result, the forward-biased D forces $v_{out}$ to become equal to $V_{REF}(V_{out}=V_{REF})$ (when the input signal $v_{in}>V_{REF}$). In this way, the output voltage $v_{out}$ is clamped to reference $V_{REF}$. Note that when the peak detector does not detect a negative swing (output exhibits positive swing), the first diode D operates in a reverse-biased region and causes the output voltage $v_{out}$ to follow $v_{in}(v_{out}=v_{in})$.

FIG. 4B is a diagram illustrating a conventional negative-swing-limiting clamp similar to the clamp of FIG. 1A, but the polarity of D is flipped. For the limiter shown in FIG. 4B, where the voltage limiter limits the limited output signal when the voltage of the input signal is less than the reference voltage (i.e., a negative-swing-limiter), the peak detector detects a positive swing at the output of the opamp and the output node of the opamp produces a bias which forward-biases the first diode. When there is a positive swing at the output of the opamp, the opamp output indicates that the input signal $v_{in}<V_{REF}$. The peak detector 404 detects the output of A swings high and forward-biases D. As a result, the forward-biased D causes output voltage $v_{out}$ to become equal to $V_{REF}(V_{out}=V_{REF})$, when the input signal $v_{in}<V_{REF}$). In this way, the output voltage $v_{out}$ is clamped to reference $V_{REF}$. Note that when the peak detector does not detect a positive swing (output exhibits negative swing), the first diode D operates in a reverse-biased region and causes the output voltage $v_{out}$ to follow $v_{in}(v_{out}=v_{in})$.

The resulting limiters of FIGS. 4A-B are faster and more accurate than the limiter shown in FIGS. 1A-B.

Example Implementations of Peak Detector

Figure 5A:
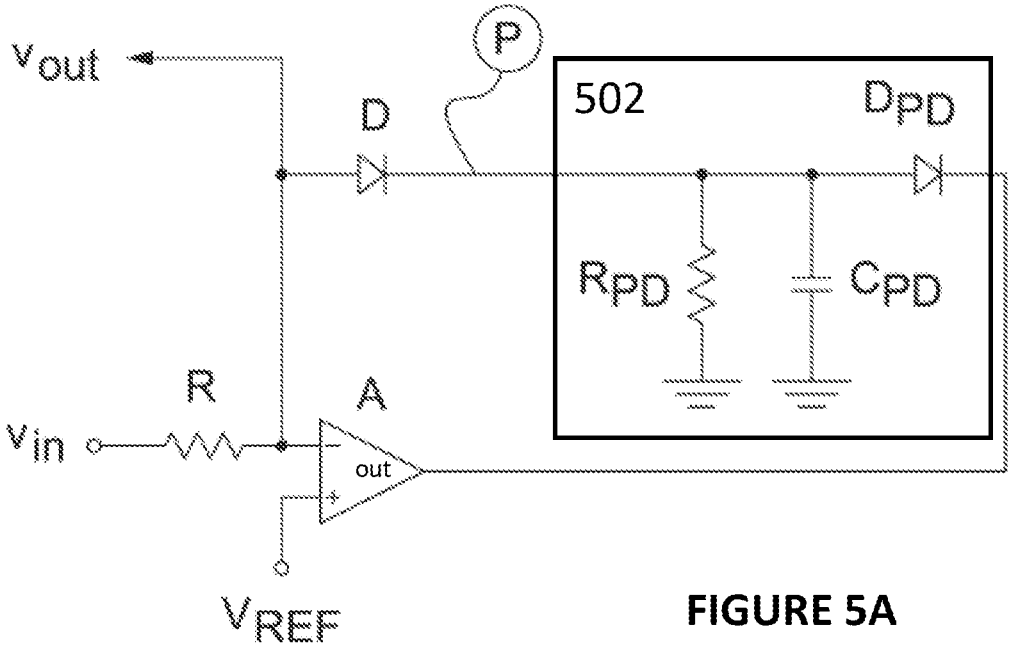
FIG. 5A is a diagram illustrating an exemplary implementation of the positive-swing-limiting precision voltage clamp shown in FIG. 4A, according to some embodiments of the disclosure.
Figure 5B:
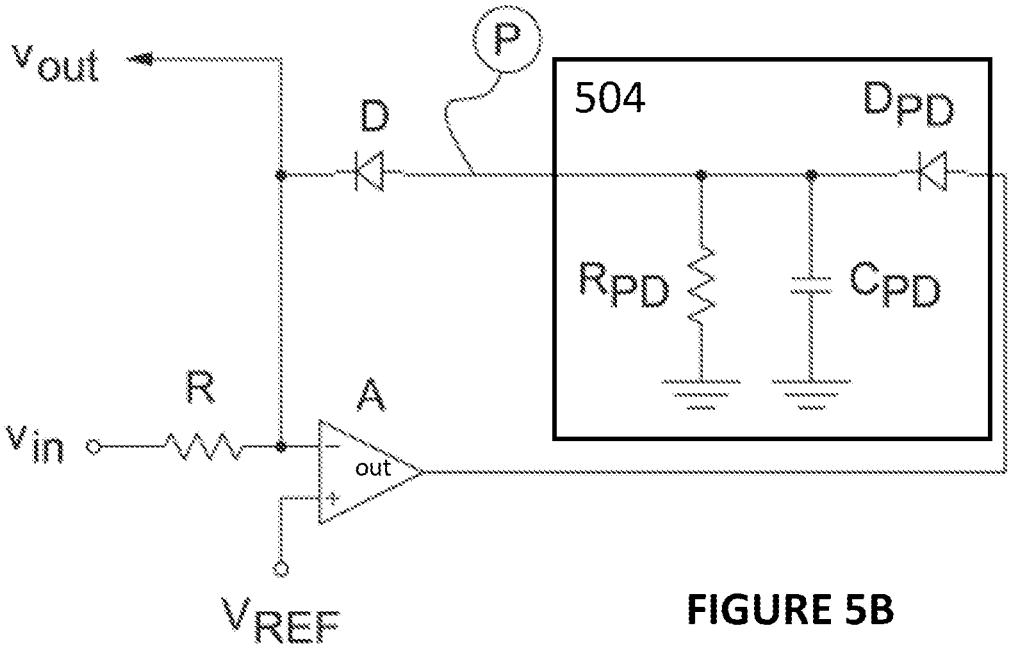
FIG. 5B is a diagram illustrating an exemplary implementation of the negative-swing-limiting clamp shown in FIG. 4B, according to some embodiments of the disclosure.

The behavior of the peak detector is provided by a peak detector device, which can be implemented using different types of devices which can detect positive or negative swings at the output of the opamp. FIGS. 5A-B shows first-order implementations using a second diode $D_{PD}$ as the peak detector device. The second diode $D_{PD}$ can react to positive or negative swings at the output of the opamp and provide proper bias to the first diode $D_{PD}$. The first-order implementations further includes a capacitor $C_{PD}$ and a bleeder resistor $R_{PD}$. The capacitor $C_{PD}$ can serve as a memory device for storing the maximum voltage (minus one diode voltage) presented at the peak detector input. The bleeder resistor $R_{PD}$ provides a path for slowly discharging $C_{PD}$ such that the peak detector can accommodate input signals of different amplitudes. The polarity of the second diode $D_{PD}$ establishes the polarity of the peak detector itself (i.e., whether the peak detector is a negative-swing or a positive-swing detector) and the convergence of the voltage on node P to the proper value required for turning on the first diode D during overvoltage or undervoltage conditions.

At low input frequencies, the effect of capacitor $C_{PD}$ and bleeder resistor $R_{PD}$ is negligible, and the voltage limiter would perform in a similar way as the voltage limiter of FIG. 1A or FIG. 1B, exhibiting crisp clamping action as illustrated in FIG. 2A or 2B. Conversely, if capacitor $C_{PD}$ and bleeder resistor $R_{PD}$ are missing from the circuit (or if capacitor $C_{PD}\rightarrow 0$ and bleeder resistor $R_{PD}\rightarrow\infty$), the transient response of the circuit is dominated by the opamp A and not the diodes. The voltage limiters of FIGS. 5A-B would operate in a similar way as the voltage limiters of FIGS. 1A-B respectively.

FIG. 5A is a diagram illustrating an exemplary implementation of the positive-swing-limiting precision voltage clamp shown in FIG. 4A, according to some embodiments of the disclosure. The peak detector 502 shows a first terminal of the second diode $D_{PD}$ (the cathode of $D_{PD}$) is connected to the output of the opamp at the input node of the peak detector. A second terminal of the second diode $D_{PD}$ (the anode of $D_{PD}$) is connected to the second terminal of the first diode (the cathode of D) at the output node of the peak detector (shown as node P). The bleeder resistor $R_{PD}$ and the capacitor $C_{PD}$ are individually connected to the output node of the peak detector. In this specific example, the other terminals of the capacitor $C_{PD}$ and the bleeder resistor $R_{PD}$ are connected to ground (in some other examples, the other terminals of $C_{PD}$ and $R_{PD}$, either or both, can be connected to some voltage rail). When a negative swing at the output of the opamp is detected by the peak detector 502 (during overvoltage conditions, or $v_{in}>V_{REF}$), the negative swing forward biases the second diode $D_{PD}$. The second diode $D_{PD}$ can then provide the bias to the first diode D to operate the first diode D in the forward bias region, and forces $v_{out}$ to become equal to $V_{REF}$ ($v_{out}=V_{REF}$). In this way, the output voltage $v_{out}$ is clamped to reference $V_{REF}$.

FIG. 5B is a diagram illustrating an exemplary implementation of the negative-swing-limiting clamp shown in FIG. 4B, according to some embodiments of the disclosure. Note the first diode D of FIG. 5B is reversed in polarity when compared to the first diode D of FIG. 5A. The peak detector 505 shows a first terminal of the second diode $D_{PD}$ (the anode of $D_{PD}$) is connected to the output of the opamp at the input node of the peak detector. A second terminal of the second diode $D_{PD}$ (the cathode of $D_{PD}$) is connected to the second terminal of the first diode (the anode of D) at the output node of the peak detector (shown as node P). The bleeder resistor $R_{PD}$ and the capacitor $C_{PD}$ are individually connected to the output node of the peak detector. In this specific example, the other terminals of the capacitor $C_{PD}$ and the bleeder resistor $R_{PD}$ are connected to ground (in some other examples, the other terminals of $C_{PD}$ and $R_{PD}$, either or both, can be connected to some voltage rail). When a positive swing at the output of the opamp is detected by the peak detector 504 (during undervoltage conditions, or $v_{in}<V_{REF}$), the positive swing forward biases the second diode $D_{PD}$. The second diode $D_{PD}$ can provide the bias to the first diode D to operate the first diode D in the forward bias region, and forces $v_{out}$ to become equal to $V_{REF}$($v_{out}=V_{REF}$). In this way, the output voltage $v_{out}$ is clamped to reference $V_{REF}$.

Figure 6A:
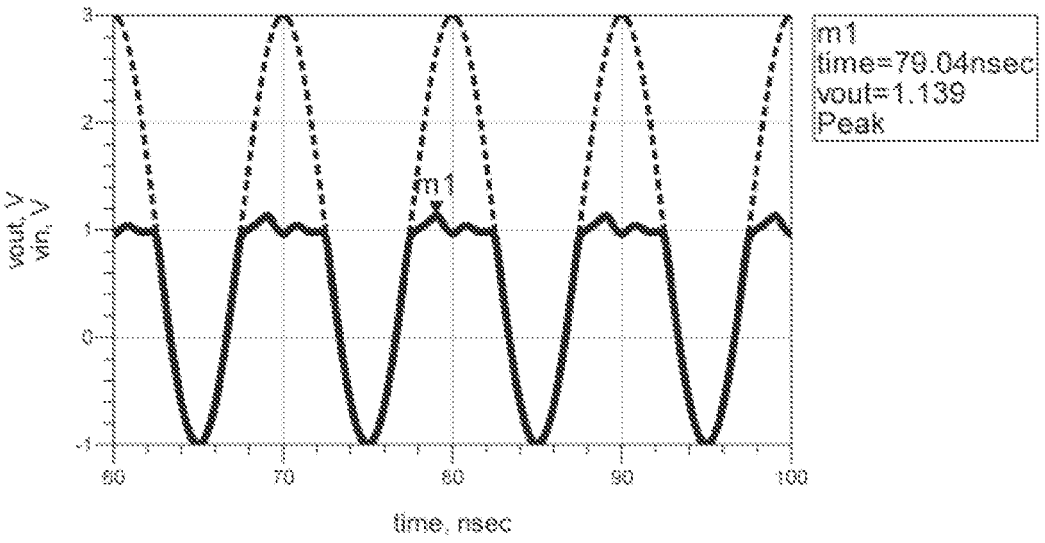
FIG. 6A illustrates a typical voltage output of the clamp of FIG. 5A (indicated with a solid line), when the same moderate-frequency signal used in FIG. 3A is applied to the input (indicated with a dotted line), using an exemplary $V_{REF}$=1V, according to some embodiments of the disclosure.
Figure 6B:
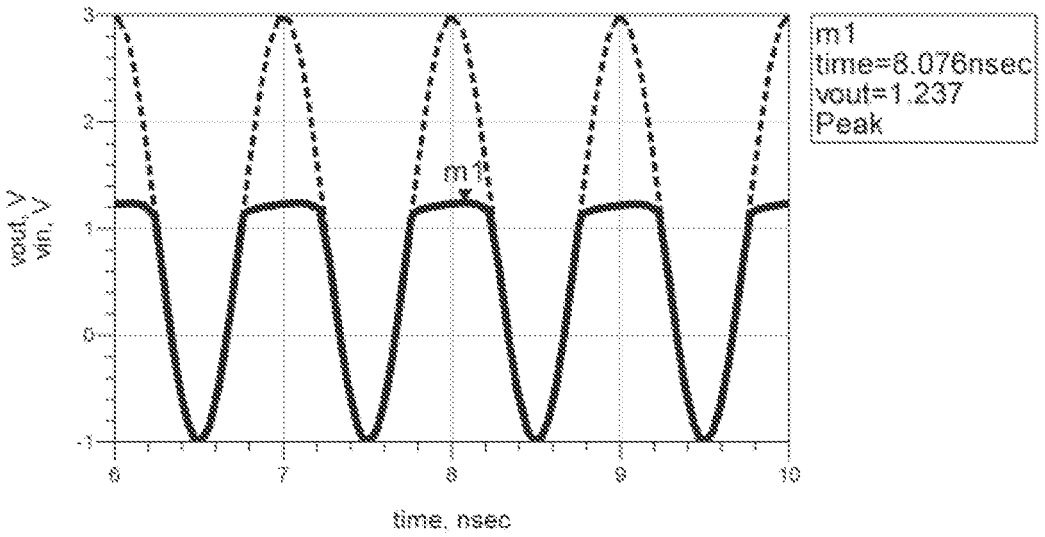
FIG. 6B illustrates a typical voltage output of the clamp of FIG. 5A (indicated with a solid line), when the same high-frequency signal used in FIG. 3B is applied to the input (indicated with a dotted line), using an exemplary $V_{REF}$=1V, according to some embodiments of the disclosure.

FIG. 6A illustrates a typical voltage output of the clamp of FIG. 5A (indicated with a solid line), when the same moderate-frequency signal used in FIG. 3A is applied to the input (indicated with a dotted line), using an exemplary $V_{REF}$=1V, according to some embodiments of the disclosure. Using values such as 1-100 pF for $C_{PD}$, 1-100 KΩ for $R_{PD}$, and $D_{PD}$ being substantially identical to D, the maximum overshoot of the voltage output $v_{out}$ is approximately 0.139 V, which is an improvement over the results seen in FIG. 3A (where the overshoot is approximately 0.281 V). FIG. 6B illustrates a typical voltage output of the clamp of FIG. 5A (indicated with a solid line), when the same high-frequency signal used in FIG. 3B is applied to the input (indicated with a dotted line), using an exemplary $V_{REF}$=1V, according to some embodiments of the disclosure. Using values such as 1-100 pF for $C_{PD}$, 1-100 KΩ for $R_{PD}$, and $D_{PD}$ being substantially identical to D, the maximum overshoot of the voltage output $v_{out}$ is approximately 0.237 V, which is an improvement over the results seen in FIG. 3B (where the overshoot is approximately 0.724 V). These plots clearly show the advantage of the peak detector 502 and peak detector 504 over the topology of FIGS. 1A-B without the peak detectors. The resulting voltage limiter of FIGS. 5A-B is thus capable of providing a smaller transient overshoot (or undershoot), and therefore, maintain greater dynamic precision at moderate and high frequencies than the topology of FIGS. 1A-B.

Multi-Phase Voltage Limiters

The basic voltage limiter can be extended (duplicated at least in part) for a plurality of inputs of various phases. A multi-phase voltage limiter may have a plurality of inputs and an equal number of outputs for providing limited and each of the outputs can be all be clamped to a particular reference voltage. The multi-phase-shifted inputs can including pseudo-differential signals or M input signals with various phases. This multi-phase voltage limiter can be implemented with minimal integrated-circuit area penalty, by directly connecting the peak detector outputs of the individual branches and sharing the peak-detector capacitor for high-frequency clamping. The following sections examines these implementations in further detail.

Example Multi-Phase Voltage Limiter with Pseudo-Differential Inputs

Figure 7:
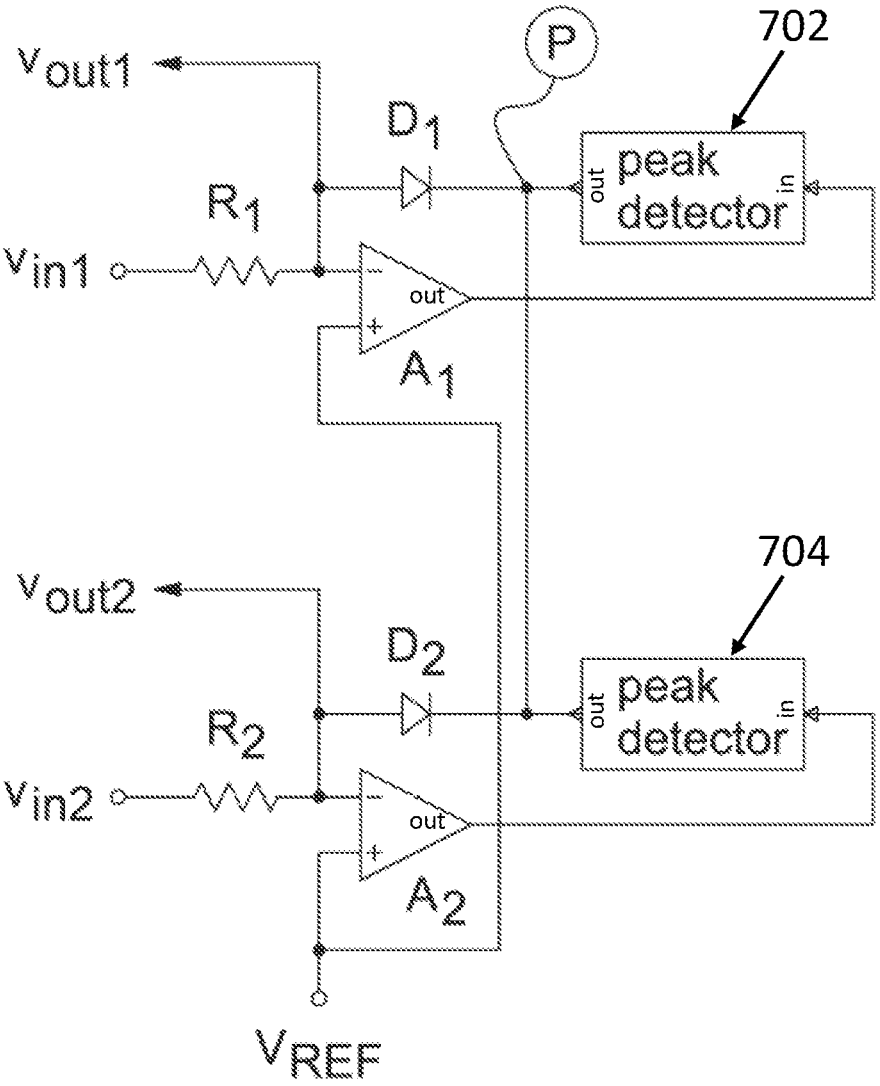
FIG. 7 is a diagram illustrating an exemplary two-input (pseudo-differential) positive-swing-limiting precision voltage clamp including two clamps of the type illustrated in FIG. 4A, whose peak detector outputs are directly connected, according to some embodiments of the disclosure.

FIG. 7 is a diagram illustrating an exemplary two-input (pseudo-differential) positive-swing-limiting precision voltage clamp including two clamps of the type illustrated in FIG. 4A, whose peak detector outputs are directly connected, according to some embodiments of the disclosure. The pseudo-differential inputs take the form $v_{in1}(t)=V_{DC}+V_{IN}\cdot\sin[2\pi f_0 t+\Phi_0]$, $v_{in2}(t)=V_{DC}-V_{IN}\cdot\sin[2\pi f_0 t+\Phi_0]$. The pseudo-differential voltage limiter has two branches which individually provide a similar function as the voltage limiter of FIG. 4A for limiting the input voltages $v_{in1}$ and $v_{in2}$. Recognizing that at high input frequencies $f_0$ the outputs of the peak detectors 702 and 704 converge to the same value which ensures the same clamping voltage for each input signal, these outputs of peak detectors 702 and 704 can be tied together at a single node P as shown. While not necessary, the advantageous aspect of being able to tie all the outputs of the peak detectors at a single node allows the reuse of the peak detector capacitor $C_{PD}$ for peak detectors 702 and 704, allowing tremendous area savings in integrated-circuit real estate. In other words, the need to provide a separate peak detector capacitor $C_{PD}$ for every peak detector is avoided and one peak detector capacitor $C_{PD}$ maintaining the same capacitance value as $C_{PD}$ of FIG. 5A or 5B would suffice. Effectively, the peak detector capacitor $C_{PD}$ (and the bleeder resistor $R_{PD}$) can be used for a multiplicity of peak detectors.

Figure 8:
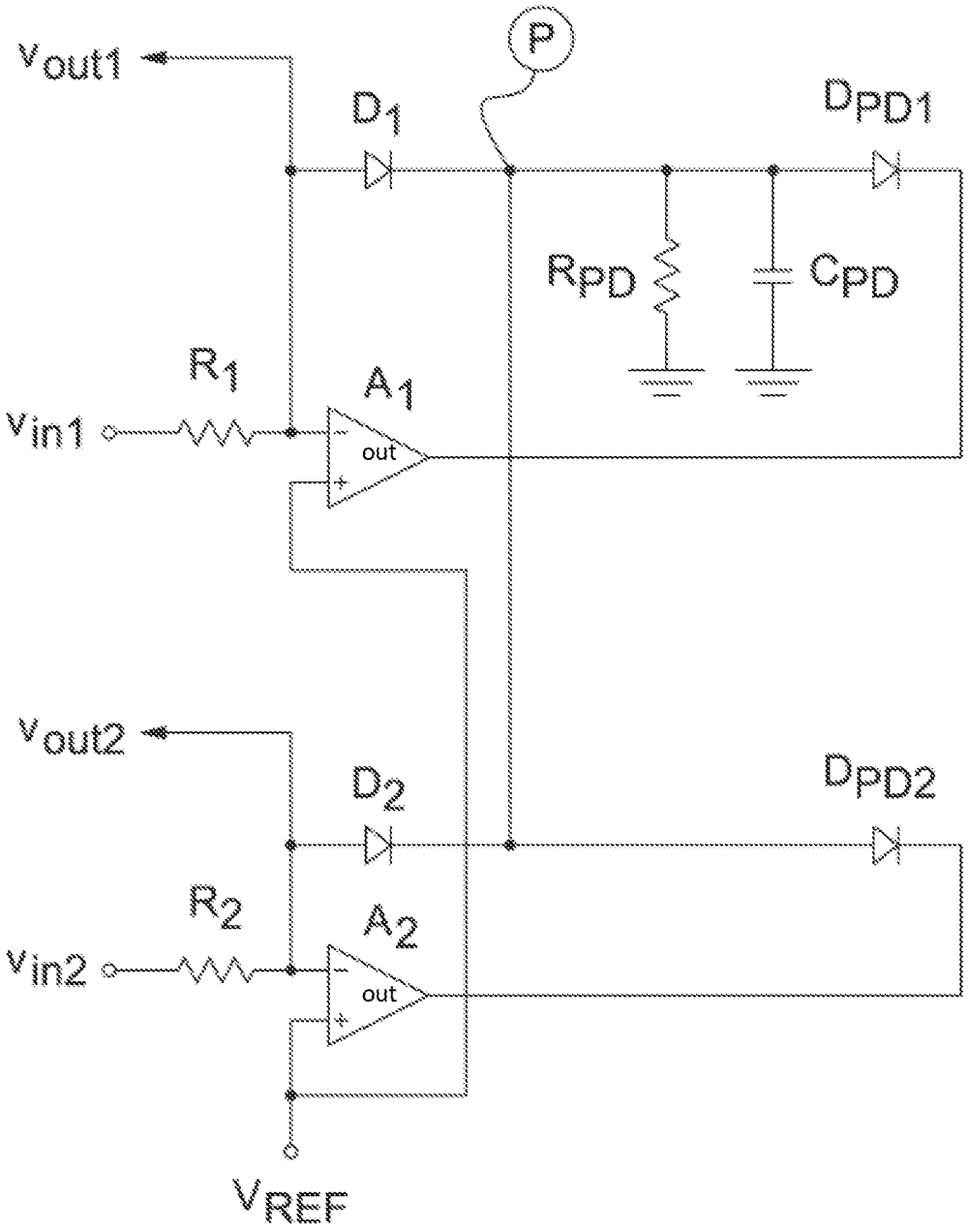
FIG. 8 is a diagram detailing an exemplary implementation for the peak detector circuits in FIG. 7, having a common detection capacitor $C_{PD}$ and a common bleed resistor $R_{PD}$, according to some embodiments of the disclosure.

FIG. 8 is a diagram detailing an exemplary implementation for the peak detector circuits in FIG. 7, having a common detection capacitor $C_{PD}$ and a common bleed resistor $R_{PD}$, according to some embodiments of the disclosure. This shows a multi-phase voltage limiter, specifically, a pseudo-differential voltage limiter, for limiting input signals having 180 degrees opposite phases ($v_{in1}$ and $v_{in2}$) and producing limited output signals ($v_{out1}$ and $v_{out2}$) with respect to a reference voltage $V_{REF}$. This particular implementation clamps positive swings of the input signals (following the operation described in relation to FIG. 4A). The pseudo-differential voltage limiter can include a top branch for processing $v_{in1}$ and a bottom branch for processing $v_{in2}$.

For the top branch, the pseudo differential voltage limiter includes a first operational amplifier (opamp) $A_1$ having the reference voltage $V_{REF}$ connected to the non-inverting input of the first opamp $A_1$, a first input signal $v_{in1}$ applied to a first resistor $R_1$ connected to the inverting input of the first opamp $A_1$, and a first negative feedback path. The first negative feedback path connects the output of the first opamp $A_1$ to the inverting input of the first opamp $A_1$. A first diode $D_1$ is provided in the first negative feedback path, wherein a first terminal of the first diode (the anode of $D_1$) provides a first limited output signal $v_{out1}$. A first peak detector is provided in the negative feedback path, having a first peak detector device (in this case $D_{PD1}$), a bleeder resistor $R_{PD}$, and a capacitor $C_{PD}$, wherein the input node of the first peak detector is connected to the output of the first opamp $A_1$, and the output of the first peak detector (the node P) is connected to a second terminal of the first diode $D_1$ (the cathode of $D_1$).

For the bottom branch, the pseudo-differential voltage limiter includes a second opamp $A_2$ whose non-inverting input is connected to the non-inverting input of the first opamp $A_1$ (and thus the reference voltage $V_{REF}$), a second input signal $v_{in2}$ applied to a second resistor $R_2$ connected to the inverting input of the second opamp $A_2$, and a second negative feedback path. The second negative feedback path connects the output of the second opamp $A_2$ to the inverting input of the second opamp $A_2$. A second diode $D_2$ is provided in the second negative feedback path, wherein a first terminal of the second diode $D_2$ (the anode of $D_2$) provides a second limited output signal $v_{out2}$. A second peak detector having a second peak detector device (in this case simply $D_{PD2}$ and no separate $R_{PD}$ and $C_{PD}$ required) is provided in the second negative feedback path, wherein the input node of the second peak detector is connected to the output of the second opamp $A_2$. The output node of the second peak detector (the node P) is connected to the second terminal of the second diode $D_2$ (the cathode of $D_2$) and the output node of the first peak detector (the node P also connected to the second terminal (cathode) of the first diode $D_1$). Effectively, the output nodes of the peak detector of the top branch and the output node of the peak detector of the bottom branch are connected to a single node (the node P).

The first peak detector is configured to detect a first swing (negative swing, in this example) at the output of the first opamp $A_1$ and provide a first bias to the second terminal of the first diode $D_1$ (cathode of $D_1$, in this example) and the second terminal of the second diode $D_2$ (cathode of $D_2$, in this example) when the first swing is detected. The second peak detector is configured to detect a second swing (negative swing, in this example) at the output of the second opamp $A_2$ and provide a second bias to the second terminal of the second diode $D_2$ (cathode of $D_2$, in this example) and the second terminal of the first diode $D_1$ (cathode of $D_1$, in this example) when the second swing is detected. It can be seen from FIG. 8 that the effect of the bleeder resistor $R_{PD}$ and the peak detector capacitor $C_{PD}$ can be shared between the first peak detector device (in this case $D_{PD1}$) and the second peak detector device (in this case $D_{PD2}$).

Figure 9A:
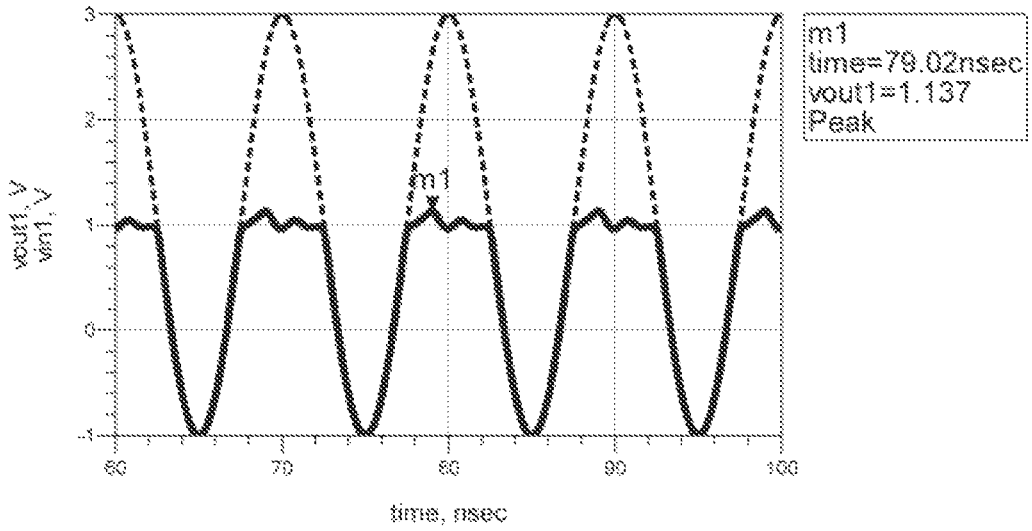
FIGS. 9A-B illustrate typical voltage outputs of the clamp of FIG. 8 (indicated with respective solid line), when a pseudo-differential sinusoidal signal of the same moderate frequency as in FIG. 3A is applied to the inputs (indicated with respective dotted lines), using an exemplary $V_{REF}$=1V, according to some embodiments of the disclosure.
Figure 9B:
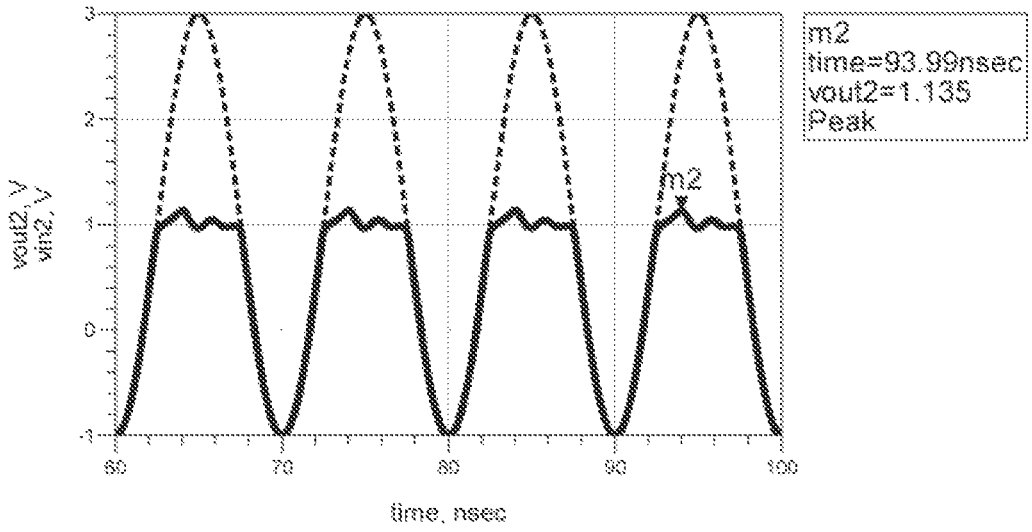
Figure 10A:
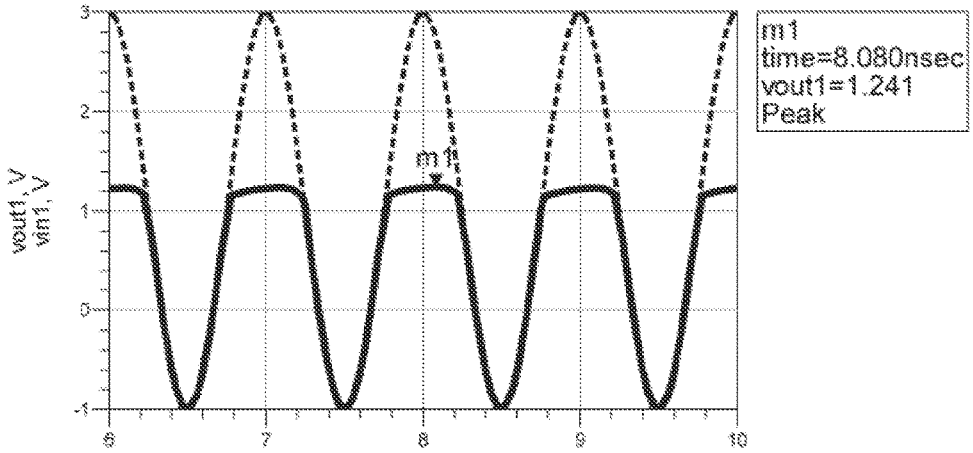
FIGS. 10A-B illustrate typical voltage outputs of the clamp of FIG. 8 (indicated with respective solid lines), when a pseudo-differential sinusoidal signal of the same high frequency as in FIG. 3B is applied to the inputs (indicated with respective dotted lines), using an exemplary $V_{REF}$=1V, according to some embodiments of the disclosure.
Figure 10B:
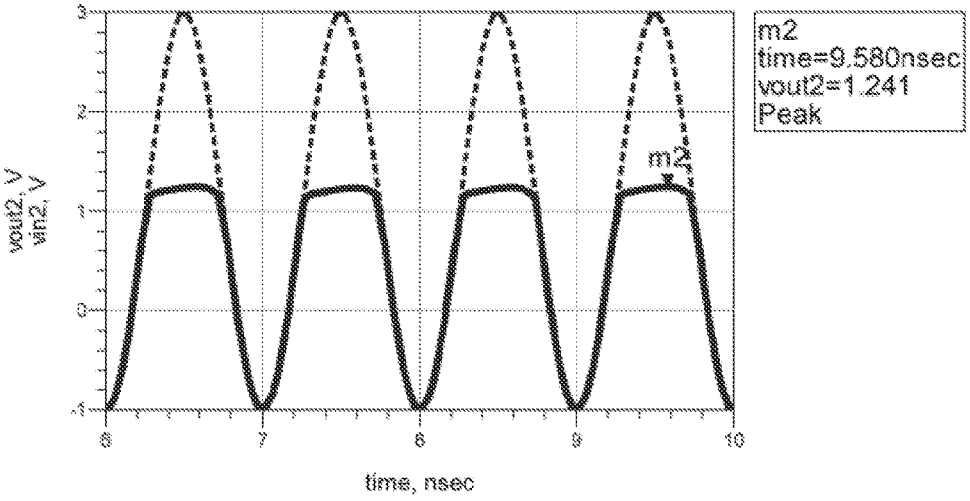

FIGS. 9A-B illustrate typical voltage outputs of the clamp of FIG. 8 (indicated with respective solid line), when a pseudo-differential sinusoidal signal of the same moderate frequency as in FIG. 3A is applied to the inputs (indicated with respective dotted lines), using an exemplary $V_{REF}$=1V, according to some embodiments of the disclosure. The maximum overshoot of the voltage outputs $v_{out1}$ and $v_{out2}$ is approximately 0.135-0.137 V, which is an improvement over the results seen in FIG. 3A (where the overshoot is approximately 0.281 V). FIGS. 10A-B illustrate typical voltage outputs of the clamp of FIG. 8 (indicated with respective solid lines), when a pseudo-differential sinusoidal signal of the same high frequency as in FIG. 3B is applied to the inputs (indicated with respective dotted lines), using an exemplary $V_{REF}$=1V, according to some embodiments of the disclosure. The maximum overshoot of the voltage outputs $v_{out1}$ and $v_{out2}$ is approximately 0.241 V, which is an improvement over the results seen in FIG. 3A (where the overshoot is approximately 0.724 V). These plots clearly show the pseudo-differential voltage limiter maintains the advantage of the peak detector over the topology of FIGS. 1A-B without the peak detectors.

The pseudo-differential voltage limiter of FIG. 8 remains capable of providing a smaller transient overshoot (or undershoot if configured with diodes having a reversed polarity), and therefore, continues to maintain greater dynamic precision at moderate and high frequencies than the topology of FIGS. 1A-B. It is noted that this topology of FIG. 8 can also be used for implementations involving a multi-phase limiter adapted to clamp negative swings, where the polarities of the diodes are flipped. Voltage clamping speed and accuracy and the area savings of sharing the peak detector capacitance continue to apply.

Example Multi-Phase Voltage Limiter with M Inputs Having Different Phases

Besides using the voltage limiter structures of FIGS. 4A-B for pseudo-differential inputs, the voltage limiter structures can also be used for an arbitrary number M inputs having different phases. Specifically, the M input signals $v_{ink}$ can take the form $$v_{ink}(t) = V_{DC} + V_{IN} \cdot \sin\left[2\pi f_0\left(t + \frac{k-1}{Mf_0}\right) + \Phi_0\right],$$

k=1, . . . , M. FIG. 11 is a diagram illustrating an exemplary multi-input positive-swing-limiting precision voltage clamp including M clamps of the type illustrated in FIG. 4A, whose peak detector outputs are directly connected, according to some embodiments of the disclosure. As shown, the multi-phase voltage limiter applies the same principles of the pseudo-differential voltage limiter of FIG. 7, and replicates (at least in part), voltage limiter structures from FIG. 4A for each input. As seen in FIGS. 7 and 8, the pseudo-differential voltage limiter includes two branches for processing pseudo-differential input signals. To extend the pseudo-differential voltage limiter principles to a general multi-phase voltage limiter, the structure of a voltage limiter (such as one seen in FIGS. 4A-B) can be replicated at least in part to provide M branches to process M input signals of different phases. Rather than having M bleeder resistors and M peak detector capacitors, one or more of the resistors and capacitors can be "omitted" or in other words one or more of the resistors and capacitors can be "shared" among the branches by connecting the output nodes of the peak detectors (node P) together.

FIG. 12 is a diagram, detailing an implementation for the peak detector circuits in FIG. 11, having a common detection capacitor $C_{PD}$ and a common bleed resistor $R_{PD}$, according to some embodiments of the disclosure. Following the same principles of the pseudo-differential voltage limiter of FIG. 7, it can be recognized that at high input frequencies $f_0$ the outputs of the peak detectors for the M branches converge to the same value which ensures the same clamping voltage for each one of the M input signals, these outputs of M peak detectors be tied together at a single node P as shown. Again, this advantageous aspect allows the reuse of the peak detector capacitor $C_{PD}$ for M peak detectors, allowing tremendous area savings in integrated-circuit real estate.

FIGS. 13A-D illustrate typical voltage outputs of the clamp of FIG. 12 (indicated with respective solid lines), when a moderate-frequency 4-phase sinusoidal voltage is applied to the inputs (indicated with respective solid lines), using an exemplary $V_{REF}$=1V, where $$v_{ink}(t) = V_{DC} + V_{IN} \cdot \sin\left[2\pi f_0\left(t + \frac{k-1}{Mf_0}\right) + \Phi_0\right],$$

k=1, . . . , M=4; $V_{DC}$=1V; $V_{IN}$=2V and the moderate frequency is the same as in FIG. 3A, according to some embodiments of the disclosure. The maximum overshoot of the voltage outputs $v_{out1}$, $v_{out2}$, $v_{out3}$, $v_{out4}$ is approximately 0.084-0.085 V, which is an improvement over the results seen in FIG. 3A (where the overshoot is approximately 0.281 V). FIGS. 14A-D illustrate typical voltage outputs of the clamp of FIG. 12 (indicated with respective solid lines), when a high-frequency 4-phase sinusoidal voltage is applied to the inputs (indicated with respective solid lines), using an exemplary $V_{REF}$=1V, where $$v_{ink}(t) = V_{DC} + V_{IN} \cdot \sin\left[2\pi f_0\left(t + \frac{k-1}{Mf_0}\right) + \Phi_0\right],$$

k=1, . . . , M=4; $V_{DC}$=1V; $V_{IN}$=2V and the high frequency is the same as in FIG. 3B, according to some embodiments of the disclosure. The maximum overshoot of the voltage outputs $v_{out1}$, $v_{out2}$, $v_{out3}$, $v_{out4}$ is approximately 0.223-0.226 V, which is an improvement over the results seen in FIG. 3B (where the overshoot is approximately 0.724 V).

These plots clearly show the multi-phase voltage limiter maintains the advantage of the peak detector over the topology of FIGS. 1A-B without the peak detectors. In cases where M is larger, the clamping action ensures less voltage ripple or variation of the clamped signal because several phase-shifted signals contribute to the rectified voltage.

Example CMOS Implementations of the Opamp and Peak Detector: Transistor as Peak Detector Device FIG. 15A is a diagram detailing an exemplary CMOS implementation of the clamp of FIG. 4A, according to some embodiments of the disclosure. This CMOS implementation realizes the voltage limiter shown in FIG. 4A for clamping positive swings. Furthermore, $V_{DD}$ serves as a single positive direct current (DC) supply for supporting the voltage limiter. In this implementation, the peak detector comprises a p-type metal-oxide semiconductor field effect transistor (PMOS transistor) $M_P$, a bleeder resistor $R_{PD}$, and a capacitor $C_{PD}$. Specifically, the gate of the PMOS transistor $M_P$ is connected to the output of the opamp A (indicated as "out") at the input node of the peak detector. The source of the PMOS transistor $M_P$ is connected to the second terminal of the first diode (the cathode of D) at the output node of the peak detector (node P). The bleeder resistor $R_{PD}$ and the capacitor $C_{PD}$ are individually connected to the output node of the peak detector (node P). Through this configuration of the PMOS transistor, a negative swing at the output of the opamp A turns on the PMOS transistor.

Note that the other terminal of the bleeder resistor $R_{PD}$ is connected to $V_{DD}$; the other terminal of the capacitor $C_{PD}$ (indicated by reference voltage $V_{REFC}$ provided at that terminal) can be connected to $V_{DD}$ or ground, depending on the reference node for the clamping reference voltage $V_{REF}$ (i.e., if $V_{REF}$ is referenced to ground, then $V_{REFC}$=ground; if $V_{REF}$ is referenced to $V_{DD}$ then $V_{REFC}$=$V_{DD}$). $R_{IN}$ can serve the same role as R of FIG. 4A, and can be removed from the circuit in cases where the voltage limiter is connected directly to nodes or across devices that can provide only finite currents to the voltage limiter (e.g., for limiting voltage transients across transistors). The peak detector bleeder resistor $R_{PD}$ ensures that the clamping diode D is reverse biased for $v_{in} \leq V_{REF}$. The opamp A can be a voltage opamp or an operational transconductance amplifier (having current output instead of voltage output, which can be a more common way of providing gain in CMOS designs).

FIG. 15B is diagram detailing an exemplary CMOS implementation of the clamp of FIG. 4B, according to some embodiments of the disclosure. This CMOS implementation realizes the voltage limiter shown in FIG. 4B for clamping negative swings. Furthermore, $V_{DD}$ serves as a single positive direct current (DC) supply for supporting the voltage limiter. In this implementation, the peak detector comprises a n-type metal-oxide semiconductor field effect transistor (NMOS transistor) $M_N$, a bleeder resistor $R_{PD}$, and a capacitor $C_{PD}$. Specifically, the gate of the NMOS transistor $M_N$ is connected to the output of the opamp A (indicated as "out") at the input node of the peak detector. The source of the NMOS transistor $M_N$ is connected to the second terminal of the first diode (the cathode of D) at the output node of the peak detector (node P). The bleeder resistor $R_{PD}$ and the capacitor $C_{PD}$ are individually connected to the output node of the peak detector (node P). Through this configuration of the NMOS transistor, a positive swing at the output of the opamp A turns on the NMOS transistor.

Note that the other terminal of the bleeder resistor $R_{PD}$ is connected to ground; the other terminal of the capacitor $C_{PD}$ (indicated by reference voltage $V_{REFC}$ provided at that terminal) can be connected to $V_{DD}$ or ground, depending on the reference node for the clamping reference voltage $V_{REF}$ (i.e., if $V_{REF}$ is referenced to ground, then $V_{REFC}$=ground; if $V_{REF}$ is referenced to $V_{DD}$ then $V_{REFC}$=$V_{DD}$). $R_{IN}$ can serve the same role as R of FIG. 4B, and can be removed from the circuit in cases where the voltage limiter is connected directly to nodes or across devices that can provide only finite currents to the voltage limiter (e.g., for limiting voltage transients across transistors). The peak detector bleeder resistor $R_{PD}$ ensures that the clamping diode D is reverse biased for $v_{in} \geq V_{REF}$. The opamp A can be a voltage opamp or an operational transconductance amplifier (having current output instead of voltage output, which can be a more common way of providing gain in CMOS designs).

FIG. 16 is a diagram detailing a CMOS implementation of a two-input (pseudo-differential) positive-swing-limiting precision voltage clamp having two branches, i.e., two clamps of the type illustrated in FIG. 15A, whose peak detector outputs are directly connected, according to some embodiments of the disclosure. Respective branches clamp the pseudo-differential input signals $v_{in+}$ and $v_{in-}$. In this FIGURE, $R_{IN+}=R_{IN-}$, and all other components are substantially identical to and have the same roles as the single-clamp counterparts in FIG. 15A. In the same way as FIGS. 8 and 12, the capacitor $C_{PD}$ and the bleeder resistor $R_{PD}$ are shared between the two branches by connecting the output nodes of peak detectors (i.e., sources of the PMOS transistors in the peak detectors). FIG. 17 is a diagram illustrating yet another embodiment of the present invention, detailing a CMOS implementation of a two-input (pseudo-differential) negative-swing-limiting precision voltage clamp comprised of two branches, i.e., two clamps of the type illustrated in FIG. 15B, whose peak detector outputs are directly connected, according to some embodiments of the disclosure. Respective branches clamp the pseudo-differential input signals $v_{in+}$ and $v_{in-}$. In this FIGURE, $R_{IN+}=R_{IN-}$, and all other components are substantially identical to and have the same roles as the single-clamp counterparts in FIG. 15B. In a similar way as FIGS. 8 and 12, the capacitor $C_{PD}$ and the bleeder resistor $R_{PD}$ are shared between the two branches by connecting the output nodes of peak detectors (i.e., sources of the PMOS transistors in the peak detectors).

While pseudo-differential two-input voltage clamps are shown in FIGS. 16-17, it is noted that the branches (i.e., the opamp, the diode in the feedback path, and the peak detector having the NMOS transistor or the PMOS transistor depending on whether a positive-swing limiting precision voltage clamp or negative-swing-limiting precision voltage clamp is desired) can be replicated as M branches to provide a multi-phase voltage limiter that clamps M multi-phase inputs (while sharing the effect of the capacitor $C_{PD}$ and the bleeder resistor $R_{PD}$ among the M branches by connecting the outputs of the peak detectors of the M branches together at a single node).

Example CMOS Implementations of the Opamp and Peak Detector: Transistors Arranged in a Differential Pair as Opamp FIG. 18 is a diagram illustrating an exemplary CMOS implementation of operational amplifier A in FIG. 15B, according to some embodiments of the disclosure. Specifically, the diagram shows an exemplary CMOS implementation of a possible internal configuration of the operational transconductance amplifier A in the negative-swing-limiting clamp of FIG. 15B (note that the same principles with a complementary topology apply for the positive-swing-limiting clamp of FIG. 15A. Similar to FIG. 15B, the peak detector is implemented using an NMOS transistor $M_N$. The opamp can include substantially identical second and third NMOS transistors ($M_1$ and $M_2$) arranged in a differential pair biased by a tail current $I_0$, load current $I_1$ being half of the tail current $$\left(I_1 = \frac{I_0}{2}\right),$$

which can ensure zero offset voltage for the opamp, and a diode $D_G$ for limiting a minimum voltage at the gate of the first NMOS transistor $M_N$ when the input voltage is greater than the reference voltage (i.e., during unclamped conditions for $v_{in}>V_{REF}$). This can be important in some applications for preventing the breakdown of $M_N$. Note that a complementary topology for providing equivalent and proper function of FIG. 18 can be used for implementing the opamp of the positive-swing-limiting clamp of FIG. 15A.

FIG. 19 is a diagram detailing the use of resistors in lieu of current sources in FIG. 18, according to some embodiments of the disclosure. In this variant, the tail current $I_0$ is provided by a tail resistor $R_0$, and the load current $I_1$ is provided by a load resistor $R_1$ configured to supply half of the tail current going across the tail resistor $R_0$ (such that $$\left(\text{such that } I_1 = \frac{I_0}{2}\right).$$

It is noted that while one terminal of $R_1$ is connected to the drain of NMOS $M_1$, the other terminal of is $R_1$ possibly connected to a supply voltage $V_{DD1}$ different from $V_{DD}$ (in some cases $V_{DD1}>V_{DD}$). The supply voltage $V_{DD1}$ can be used to provide extra headroom (i.e., so that the gate of $M_N$ can swing as high as possible). The supply voltage $V_{DD1}$ and $V_{DD}$ are configured to ensure the operation of $M_N$ in the saturation region when $M_N$ turns on. Note that a complementary topology for providing equivalent and proper function of FIG. 19 can be used for implementing the opamp of the positive-swing-limiting clamp of FIG. 15A.

FIG. 20 is a diagram detailing the use of CMOS transistors for implementing the current sources in FIG. 18, according to some embodiments of the disclosure. In this variant, the tail current $I_0$ is provided by a fourth NMOS transistor $M_3$ biased by a first bias voltage $V_{BIAS1}$. The load current $I_1$ s provided by a p-type metal-oxide semiconductor field effect transistor (PMOS transistor) $M_4$ biased by a second bias voltage $V_{BIAS2}$ and configured to supply half of the tail current going across the fourth NMOS transistor $M_4$ (such that $$\left(\text{such that } I_1 = \frac{I_0}{2}\right).$$

The first and second bias voltages $V_{BIAS1}$ and $V_{BIAS2}$ ensure $M_3$ and $M_4$ to operate in the saturation region. The drain of $M_4$ is connected to the drain of NMOS $M_1$, the source of $M_1$ is possibly connected to a supply voltage $V_{DD1}$ different from $V_{DD}$ (in some cases $V_{DD1}>V_{DD}$). The supply voltage $V_{DD1}$ can be used to provide extra headroom (i.e., so that the gate of $M_N$ can swing as high as possible). The supply voltage $V_{DD1}$ and $V_{DD}$ are configured to ensure the operation of $M_N$ in the saturation region when $M_N$ turns on.

FIG. 21 is a diagram detailing an exemplary CMOS implementation of a pseudo-differential clamp for limiting negative voltage swings, according to some embodiments of the disclosure. This illustration shows replicating in part the structure shown in FIG. 18 for clamping pseudo-differential signals, applying principles of FIG. 7. Two branches are provided to clamp the two inputs. Specifically, $I_{0A}=I_{0B}$, $$I_{1A} = I_{1B} = \frac{I_{0A}}{2} = \frac{I_{0B}}{2}.$$

$M_{1A}$, $M_{2A}$, $M_{1B}$, and $M_{2B}$ are substantially identical. $M_{N1}$ and $M_{N2}$ are substantially identical. $D_1$ and $D_2$ are substantially identical. $D_{GA}$ and $D_{GB}$ are substantially identical. Note in this pseudo-differential voltage limiter, the output nodes of the respective peak detectors are joined at a single node, and effect of the bleeder resistor and the capacitor is shared between the peak detector device of the first branch and the peak detector device second branch.

FIG. 22 is a diagram detailing an exemplary CMOS implementation of a pseudo-differential clamp for limiting negative voltage swings, using resistors in lieu of current sources in FIG. 21, according to some embodiments of the disclosure. This illustration shows replicating in part the structure shown in FIG. 19 for clamping pseudo-differential signals, applying principles of FIG. 7. $R_{0A}=R_{0B}$, $R_{0A}=R_{0B}$. $M_{1A}$, $M_{2A}$, $M_{1B}$, and $M_{2B}$ are substantially identical. $M_{N1}$ and $M_{N2}$ are substantially identical. $D_1$ and $D_2$ are substantially identical. $D_{GA}$ and $D_{GB}$ are substantially identical. Note in this pseudo-differential voltage limiter, the output nodes of the respective peak detectors are joined at a single node, and effect of the bleeder resistor and the capacitor is shared between the peak detector device of the first branch and the peak detector device second branch.

FIG. 23 is a diagram detailing an exemplary CMOS implementation of a pseudo-differential clamp for limiting negative voltage swings, using MOS transistors in lieu of current sources in FIG. 21, according to some embodiments of the disclosure. This illustration shows replicating in part the structure shown in FIG. 20 for clamping pseudo-differential signals, applying principles of FIG. 7. $M_{1A}$, $M_{2A}$, $M_{1B}$, and $M_{2B}$ are substantially identical. $M_{3A}$ and $M_{3B}$ are substantially identical. $M_{4A}$ and $M_{4B}$ are substantially identical. $M_{N1}$ and $M_{N2}$ are substantially identical. $D_1$ and $D_2$ are substantially identical. $D_{GA}$ and $D_{GB}$ are substantially identical. Note in this pseudo-differential voltage limiter, the output nodes of the respective peak detectors are joined at a single node, and effect of the bleeder resistor and the capacitor is shared between the peak detector device of the first branch and the peak detector device second branch.

While pseudo-differential two-input voltage clamps are shown in FIGS. 21-23, it is noted that the branches (i.e., the opamp, the diode in the feedback path, and the peak detector having a transistor as the peak detector device, and/or current sources, etc.) can be replicated as M branches to provide a multi-phase voltage limiter that clamps M multi-phase inputs (while sharing the effect of the capacitor $C_{PD}$ and the bleeder resistor $R_{PD}$ among the M branches by connecting the outputs of the peak detectors of the M branches together at a single node).

The following tests shows results of the voltage limiter of FIG. 23 under different conditions. In these tests, the voltage limiter takes pseudo-differential inputs having the form, $$v_{ink}(t) = V_{DC} + V_{IN} \cdot \sin\left[2\pi f_0\left(t + \frac{k-1}{Mf_0}\right) + \Phi_0\right],$$

$$v_{in-}(t) = V_{DC} - V_{IN} \cdot \sin\left[2\pi f_0\left(t + \frac{k-1}{Mf_0}\right) + \Phi_0\right];$$

$V_{DC}$=1.4V; $V_{IN}$=1V, $V_{REF}$=1.3V (referenced to $V_{DD}$=2.5 V). $R_{IN+}=R_{IN-}$=500Ω.

FIG. 24A-B illustrate the simulated input voltages (indicated with respective dotted lines) and output voltages (indicated with respective solid lines) for an actual CMOS realization of the clamp of FIG. 23, at a moderate input frequency of 100 MHz, using a reference clamping voltage $V_{REF}$=1.3V, with no peak detector capacitor present in the circuit ($C_{PD}$=0), according to some embodiments of the disclosure. If peak detector capacitor $C_{PD}$ is disconnected from the circuit, the circuit of FIG. 23 is conceptually the same as the single clamp classical circuit of FIG. 1B, and both clamping sections operate in the same manner, which permits a quick comparative evaluation of the classical approach using the exact same circuit elements (most importantly the opamp). The results show an undershoot of approximately 0.101-0.107 V.

FIG. 25A-B illustrate the simulated input voltages (indicated with respective dotted lines) and output voltages (indicated with respective solid lines) for an actual CMOS realization of the clamp of FIG. 23, at a moderate input frequency of 100 MHz, using a reference clamping voltage $V_{REF}$=1.3V, with the peak detector capacitor present in the circuit and connected to $V_{DD}$, according to some embodiments of the disclosure. With the peak detector capacitor $C_{PD}$ connected in the circuit, the transient undershoot is only approximately 0.082 V, which is better than the results from FIGS. 24A-B.

FIG. 26A-B illustrate the simulated input voltages (indicated with respective dotted lines) and output voltages (indicated with respective solid lines) for an actual CMOS realization of the clamp of FIG. 23, at a high input frequency of 800 MHz, using a reference clamping voltage $V_{REF}$=1.3V, with no peak detector capacitor present in the circuit $C_{PD}$=0), according to some embodiments of the disclosure. Without the peak detector capacitor $C_{PD}$, the transient undershoot is approximately 0.277-0.278 V.

FIG. 27A-B illustrates the simulated input voltages (indicated with respective dotted lines) and output voltages (indicated with respective solid lines) for an actual CMOS realization of the clamp of FIG. 23, at a high input frequency of 800 MHz, using a reference clamping voltage $V_{REF}$=1.3V, with the peak detector capacitor present in the circuit and connected to $V_{DD}$, according to some embodiments of the disclosure. With the peak detector capacitor $C_{PD}$ connected in the circuit, the transient undershoot is only approximately 0.120-0.124 V, which is better than the results from FIGS. 26A-B.

It is noted that these advantages of accuracy with the peak detector capacitor $C_{PD}$ can also be found in other multi-phase voltage limiters leveraging the topology of FIG. 11, and leveraging the CMOS implementations shown in FIG. 15-22, and equivalents thereof.

A Method for Peak Detection in a Negative Feedback Path of an Opamp

FIG. 28 is a flow diagram illustrating a method for limiting an input signal and producing a limited output signal with respect to a reference voltage. The method can be used in a voltage limiter according to any voltage limiters described herein. In particular, the method includes detecting a swing at the output of an opamp by a peak detector in the negative feedback path of the opamp (box 2802). The method further includes providing a bias to a diode in the negative feedback path of the opamp to clamp the output signal of the voltage limiter (box 2804).

By using a peak detector in the negative feedback path of a voltage limiter in the super-diode configuration, the method allows the voltage limiter to no longer be impacted (as much) by the finite response time of the opamp when the input frequency is relatively high. The result is a method that can be used for clamping inputs which are high in frequency with good accuracy.

Variations and Implementations

In the discussions of the embodiments above, the capacitors, resistors, amplifiers, transistors, and/or other components can readily be replaced, substituted, or otherwise modified in order to accommodate particular circuitry needs. Moreover, it should be noted that the use of complementary electronic devices, hardware, etc. offer an equally viable option for implementing the teachings of the present disclosure. For instance, the CMOS implementations described herein can readily be provided using Bipolar junction transistors (BJTs).

While the embodiments described herein refers to either clamping overvoltage or undervoltage conditions, it is envisioned by the disclosure that a single circuit configuration can be used to claim both overvoltage and undervoltage conditions at two different reference voltages (e.g., clamping when $v_{in}>V_{REF_TOP}$ and clamping when $v_{in}<V_{REF_BOTTOM}$. This single configuration for clamping both overvoltages and undervoltages can also be replicated for multi-phase inputs. Taking FIGS. 4A-B as an example, the overvoltage clamp of FIG. 4A can be joined with the undervoltage clamp of FIG. 4B by ensuring $v_{in}$ of FIG. 4A-B are connected to a first node (input node), and $v_{out}$ of FIGS. 4A-B (i.e., the inverting input of the opamps) are connected to a second node. $V_{REF_TOP}$ is provided as the reference voltage to the circuit of FIG. 4A, and $V_{REF_BOTTOM}$ is provided as the reference voltage to the circuit of 4B. The result is a voltage clamp that can clamp the input signal during both overvoltage conditions and undervoltage conditions. When $v_{in}>V_{REF_TOP}$, the circuit of FIG. 4A is "activated" and forward-biases the diode of the circuit of FIG. 4A to clamp the input signal (while the circuit of FIG. 4B is "inactive"). When $v_{in}<V_{REF_BOTTOM}$, the circuit of FIG. 4B is "activated" and forward-biases the diode of the circuit of FIG. 4B to clamp the input signal (while the circuit of FIG. 4A is "inactive"). Due to a parallel configuration of the two resistors between the first node (input node) and the second node (output node), the size of resistors R can be adjusted accordingly to provide equivalent resistance.

In one example embodiment, any number of electrical circuits of the FIGURES may be implemented on a board of an associated electronic device. The board can be a general circuit board that can hold various components of the internal electronic system of the electronic device and, further, provide connectors for other peripherals. More specifically, the board can provide the electrical connections by which the other components of the system can communicate electrically. Any suitable processors (inclusive of digital signal processors, microprocessors, supporting chipsets, etc.), computer-readable non-transitory memory elements, etc. can be suitably coupled to the board based on particular configuration needs, processing demands, computer designs, etc. Other components such as external storage, additional sensors, controllers for audio/video display, and peripheral devices may be attached to the board as plug-in cards, via cables, or integrated into the board itself. In various embodiments, the functionalities described herein may be implemented in emulation form as software or firmware running within one or more configurable (e.g., programmable) elements arranged in a structure that supports these functions. The software or firmware providing the emulation may be provided on non-transitory computer-readable storage medium comprising instructions to allow a processor to carry out those functionalities.

In another example embodiment, the electrical circuits of the FIGURES may be implemented as stand-alone modules (e.g., a device with associated components and circuitry configured to perform a specific application or function) or implemented as plug-in modules into application specific hardware of electronic devices. Note that particular embodiments of the present disclosure may be readily included in a system on chip (SOC) package, either in part, or in whole. An SOC represents an IC that integrates components of a computer or other electronic system into a single chip. It may contain digital, analog, mixed-signal, and often radio frequency functions: all of which may be provided on a single chip substrate. Other embodiments may include a multi-chip-module (MCM), with a plurality of separate ICs located within a single electronic package and configured to interact closely with each other through the electronic package. In various other embodiments, the voltage limiter functionalities may be implemented in one or more silicon cores in Application Specific Integrated Circuits (ASICs), Field Programmable Gate Arrays (FPGAs), and other semiconductor chips.

It is also imperative to note that all of the specifications, dimensions, and relationships outlined herein (e.g., the number of transistors, polarity of input or output signals, types of transistors, types of diodes, types of opamps etc.) have only been offered for purposes of example and teaching only. Such information may be varied considerably without departing from the spirit of the present disclosure, or the scope of the appended claims. The specifications apply only to one non-limiting example and, accordingly, they should be construed as such. In the foregoing description, example embodiments have been described with reference to particular transistors, diodes, and/or component arrangements. Various modifications and changes may be made to such embodiments without departing from the scope of the appended claims. The description and drawings are, accordingly, to be regarded in an illustrative rather than in a restrictive sense.

Note that the activities discussed above with reference to the FIGURES are applicable to any integrated circuits that involve analog signal processing, particularly those that can execute amplification, modulation, demodulation, mixing, multiplication, rectification, filtering, some of which may be associated with processing real-time data. Certain embodiments can relate to multi-DSP signal processing, floating point processing, signal/control processing, fixed-function processing, microcontroller applications, etc.

In certain contexts, the features discussed herein can be applicable to medical systems, scientific instrumentation, wireless and wired communications, radar, industrial process control, audio and video equipment, current sensing, instrumentation (which can be highly precise), and other digital-processing-based systems.

Moreover, certain embodiments discussed above can be provisioned in signal processing technologies for medical imaging, patient monitoring, medical instrumentation, and home healthcare. This could include pulmonary monitors, accelerometers, heart rate monitors, pacemakers, etc. Other applications can involve automotive technologies for safety systems (e.g., stability control systems, driver assistance systems, braking systems, infotainment and interior applications of any kind). Furthermore, powertrain systems (for example, in hybrid and electric vehicles) can use high-precision data conversion products in battery monitoring, control systems, reporting controls, maintenance activities, etc.

In yet other example scenarios, the teachings of the present disclosure can be applicable in the industrial markets that include process control systems that help drive productivity, energy efficiency, and reliability. In consumer applications, the teachings of the signal processing circuits discussed above can be used for image processing, auto focus, and image stabilization (e.g., for digital still cameras, camcorders, etc.). Other consumer applications can include audio and video processors for home theater systems, DVD recorders, and high-definition televisions. Yet other consumer applications can involve advanced touch screen controllers (e.g., for any type of portable media device). Hence, such technologies could readily be part of smartphones, tablets, security systems, PCs, gaming technologies, virtual reality, simulation training, etc.

Note that with the numerous examples provided herein, interaction may be described in terms of two, three, four, or more electrical components. However, this has been done for purposes of clarity and example only. It should be appreciated that the system can be consolidated in any suitable manner. Along similar design alternatives, any of the illustrated components, modules, and elements of the FIGURES may be combined in various possible configurations, all of which are clearly within the broad scope of this Specification. In certain cases, it may be easier to describe one or more of the functionalities of a given set of flows by only referencing a limited number of electrical elements. It should be appreciated that the electrical circuits of the FIGURES and its teachings are readily scalable and can accommodate a large number of components, as well as more complicated/sophisticated arrangements and configurations. Accordingly, the examples provided should not limit the scope or inhibit the broad teachings of the electrical circuits as potentially applied to a myriad of other architectures.

Note that in this Specification, references to various features (e.g., elements, structures, modules, components, steps, operations, characteristics, etc.) included in "one embodiment", "example embodiment", "an embodiment", "another embodiment", "some embodiments", "various embodiments", "other embodiments", "alternative embodiment", and the like are intended to mean that any such features are included in one or more embodiments of the present disclosure, but may or may not necessarily be combined in the same embodiments.

It is also important to note that the functions related to voltage limiters described herein, illustrate only some of the possible functions that may be executed by, or within, systems illustrated in the FIGURES. Some of these operations may be deleted or removed where appropriate, or these operations may be modified or changed considerably without departing from the scope of the present disclosure. The preceding operational flows have been offered for purposes of example and discussion. Substantial flexibility is provided by embodiments described herein in that any suitable arrangements, chronologies, and configurations may be provided without departing from the teachings of the present disclosure.

Numerous other changes, substitutions, variations, alterations, and modifications may be ascertained to one skilled in the art and it is intended that the present disclosure encompass all such changes, substitutions, variations, alterations, and modifications as falling within the scope of the appended claims. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke paragraph six (6) of 35 U.S.C. section 112 as it exists on the date of the filing hereof unless the words "means for" or "step for" are specifically used in the particular claims; and (b) does not intend, by any statement in the specification, to limit this disclosure in any way that is not otherwise reflected in the appended claims.

Note that all optional features of the apparatus described above may also be implemented with respect to the method or process described herein and specifics in the examples may be used anywhere in one or more embodiments.

What is claimed is:

1. A voltage limiter for limiting an input signal and producing a limited output signal with respect to a reference voltage, the voltage limiter comprising:

an operational amplifier having the reference voltage connected to the non-inverting input of the operational amplifier, the input signal applied to a first resistor connected to the inverting input of the op operational amplifier amp, and a negative feedback path connecting the output of the operational amplifier to the inverting input of the operational amplifier;

a first diode in the negative feedback path, wherein a first terminal of the first diode provides the limited output signal; and a peak detector in the negative feedback path, wherein an input node of the peak detector is connected to the output of the operational amplifier, and an output node of the peak detector is connected to a second terminal of the first diode;

wherein the peak detector is configured to detect a swing at the output of the operational amplifier and provide a bias to the second terminal of the first diode when the swing is detected.

2. The voltage limiter of claim 1, wherein:

the voltage limiter limits the limited output signal when the voltage of the input signal is greater than the reference voltage;

the swing is a negative swing at the output of the operational amplifier; and the bias forward-biases the first diode.

3. The voltage limiter of claim 1, wherein:

the voltage limiter limits the limited output signal when the voltage of the input signal is less than the reference voltage;

the swing is a positive swing at the output of the operational amplifier; and the bias forward-biases the first diode.

4. The voltage limiter of claim 1, wherein:

the peak detector comprises a second diode, a bleeder resistor, and a capacitor.

5. The voltage limiter of claim 4, wherein:

a first terminal of the second diode is connected to the output of the operational amplifier at the input node of the peak detector;

a second terminal of the second diode is connected to the second terminal of the first diode at the output node of the peak detector; and the bleeder resistor and the capacitor are individually connected to the output node of the peak detector.

6. The voltage limiter of claim 4, wherein:

wherein a negative swing at the output of the operational amplifier forward biases the second diode.

7. The voltage limiter of claim 4, wherein:

wherein a positive swing at the output of the operational amplifier forward biases the second diode.

8. The voltage limiter of claim 1, wherein:

the peak detector comprises a p-type metal-oxide semiconductor field effect transistor (PMOS transistor), a bleeder resistor, and a capacitor.

9. The voltage limiter of claim 8, wherein:

the gate of the PMOS transistor is connected to the output of the operational amplifier at the input node of the peak detector;

the source of the PMOS transistor is connected to the second terminal of the first diode at the output node of the peak detector; and the bleeder resistor and the capacitor are individually connected to the output node of the peak detector.

10. The voltage limiter of claim 8, wherein a negative swing at the output of the operational amplifier turns on the PMOS transistor.

11. The voltage limiter of claim 1, wherein:

the peak detector comprises a n-type metal-oxide semiconductor field effect transistor (NMOS transistor), a bleeder resistor, and a capacitor.

12. The voltage limiter of claim 11, wherein:

the gate of the NMOS transistor is connected to the output of the operational amplifier at the input node of the peak detector;

the source of the NMOS transistor is connected to the second terminal of the first diode at the output node of the peak detector, and the bleeder resistor and the capacitor are individually connected to the output node of the peak detector.

13. The voltage limiter of claim 11, wherein a positive swing at the output of the operational amplifier turns on the NMOS transistor.

14. The voltage limiter of claim 1, wherein:

the peak detector comprises a first n-type metal-oxide semiconductor field effect transistor (NMOS transistor); and the operational amplifier comprises substantially identical second and third NMOS transistors arranged in a differential pair biased by a tail current, load current being half of the tail current for ensuring zero offset voltage for the operational amplifier, and a diode for limiting a minimum voltage at the gate of the first NMOS transistor when the input voltage is greater than the reference voltage.

15. The voltage limiter of claim 14, wherein:

the tail current is provided by a tail resistor; and the load current is provided by a load resistor configured to supply half of the tail current going across the tail resistor.

16. The voltage limiter of claim 14, wherein:

the tail current is provided by a fourth NMOS transistor biased by a first bias voltage; and the load current is provided by a p-type metal-oxide semiconductor field effect transistor (PMOS transistor) biased by a second bias voltage and configured to supply half of the tail current going across the fourth NMOS transistor.

17. A multi-phase voltage limiter for limiting input signals having different phases and producing limited output signals with respect to a reference voltage, the multiphase voltage limiter comprising:

a first voltage clamp comprising a first operational amplifier, a first diode, and a first peak detector, wherein an input node of the first peak detector is connected to the output of the first operational amplifier, and an output node of the first peak detector is connected to a second terminal of the first diode; and a second voltage clamp comprising a second operational amplifier, a second diode, and a second peak detector, wherein an input node of the second peak detector is connected to the output of the second operational amplifier, and an output node of the second peak detector is connected to a second terminal of the second diode and the output node of the first peak detector.

18. The multi-phase voltage limiter of claim 17, wherein a bleeder resistor and a capacitor is shared between the first peak detector and the second peak detector.

19. The multi-phase voltage limiter of claim 17, wherein:

the first negative feedback path connects the output of the first operational amplifier to the inverting input of the first operational amplifier; and the second negative feedback path connects the output of the second operational amplifier to the inverting input of the second operational amplifier.

20. The multiphase voltage limiter of claim 17, wherein:

the first peak detector is configured to detect a first swing at the output of the first operational amplifier and provide a first bias to the second terminal of the first diode and the second terminal of the second diode when the first swing is detected; and the second peak detector is configured to detect a second swing at the output of the second operational amplifier and provide a second bias to the second terminal of the second diode and the second terminal of the first diode when the second swing is detected.

21. The multi-phase voltage limiter of claim 17, wherein:

the first operational amplifier has the reference voltage connected to a non-inverting input of the first operational amplifier, a first input signal applied to a first resistor connected to the inverting input of the first operational amplifier, and a first negative feedback path;

the first diode is in the first negative feedback path, wherein a first terminal of the first diode provides a first limited output signal; and the first peak detector is in the first negative feedback path.

22. A method for limiting an input signal and producing a limited output signal with respect to a reference voltage, the method comprising:

receiving the reference voltage at a non-inverting input of an operational amplifier;

receiving the input signal at an inverting input of the operational amplifier via a resistor;

detecting a swing at an output of the operational amplifier by a peak detector in a negative feedback path of the operational amplifier; and forward-biasing a diode in the negative feedback path of the operational amplifier in response to detecting the swing.

23. The method of claim 22, further comprising:

generating the limited output signal at a terminal of the diode.

24. The method of claim 22, further comprising:

reverse-biasing the diode in response to not detecting the swing.

* * * * *